US010401765B2

(12) United States Patent
Uchiyama et al.

(10) Patent No.: US 10,401,765 B2
(45) Date of Patent: Sep. 3, 2019

(54) HEATER, IMAGE HEATING DEVICE, AND IMAGE FORMING APPARATUS WHICH MAKES TEMPERATURE DISTRIBUTION OF REGION HEATED BY HEAT GENERATING ELEMENT EVEN

(71) Applicant: CANON KABUSHIKI KAISHA, Tokyo (JP)

(72) Inventors: Takahiro Uchiyama, Mishima (JP); Atsushi Iwasaki, Susono (JP); Takashi Nomura, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/908,604

(22) Filed: Feb. 28, 2018

(65) Prior Publication Data

US 2018/0253041 A1 Sep. 6, 2018

(30) Foreign Application Priority Data

Mar. 6, 2017 (JP) ..... 2017-041743
Jan. 15, 2018 (JP) ..... 2018-004387

(51) Int. Cl.
*G03G 15/20* (2006.01)
*H05B 3/00* (2006.01)
*H05B 3/20* (2006.01)

(52) U.S. Cl.
CPC ..... *G03G 15/2017* (2013.01); *G03G 15/2039* (2013.01); *G03G 15/2042* (2013.01); *H05B 3/20* (2013.01); *H05B 2203/005* (2013.01)

(58) Field of Classification Search
CPC ..... G03G 15/2017; G03G 15/2039; G03G 15/2042; H05B 3/0014; H05B 3/20; H05B 3/265; H05B 2203/005; H05B 2203/007
USPC ..... 399/69, 334, 335, 329; 219/216, 255, 219/462.1, 470, 539
See application file for complete search history.

(56) References Cited

U.S. PATENT DOCUMENTS 9,575,444 B2 * 2/2017 Seshita ..... G03G 15/2042
2009/0226202 A1 * 9/2009 Kinouchi ..... G03G 15/2042 399/69

FOREIGN PATENT DOCUMENTS

| | | | |
|---|---|---|---|
| JP | 2007148127 A | * | 6/2007 |
| JP | 2008089974 A | * | 4/2008 |
| JP | 2009025365 A | * | 2/2009 |
| JP | 2013064794 A | | 4/2013 |
| JP | 2014059508 A | | 4/2014 |
| JP | 2015036773 A | | 2/2015 |
| JP | 2016065915 A | | 4/2016 |
| JP | 2016218376 A | | 12/2016 |
| JP | 2017009848 A | * | 1/2017 |

* cited by examiner

*Primary Examiner* — Robert B Beatty
(74) *Attorney, Agent, or Firm* — Canon U.S.A., Inc. IP Division

(57) ABSTRACT

A heater includes a plurality of heating blocks in a substrate having a plurality of temperature detection elements disposed therein. In a case where one of the heating blocks is caused to generate heat alone, temperature distribution of the heating block in a longitudinal direction is inclined from a center part to an edge. One of the plurality of temperature detection elements is arranged in a region in which the temperature distribution is inclined.

16 Claims, 21 Drawing Sheets

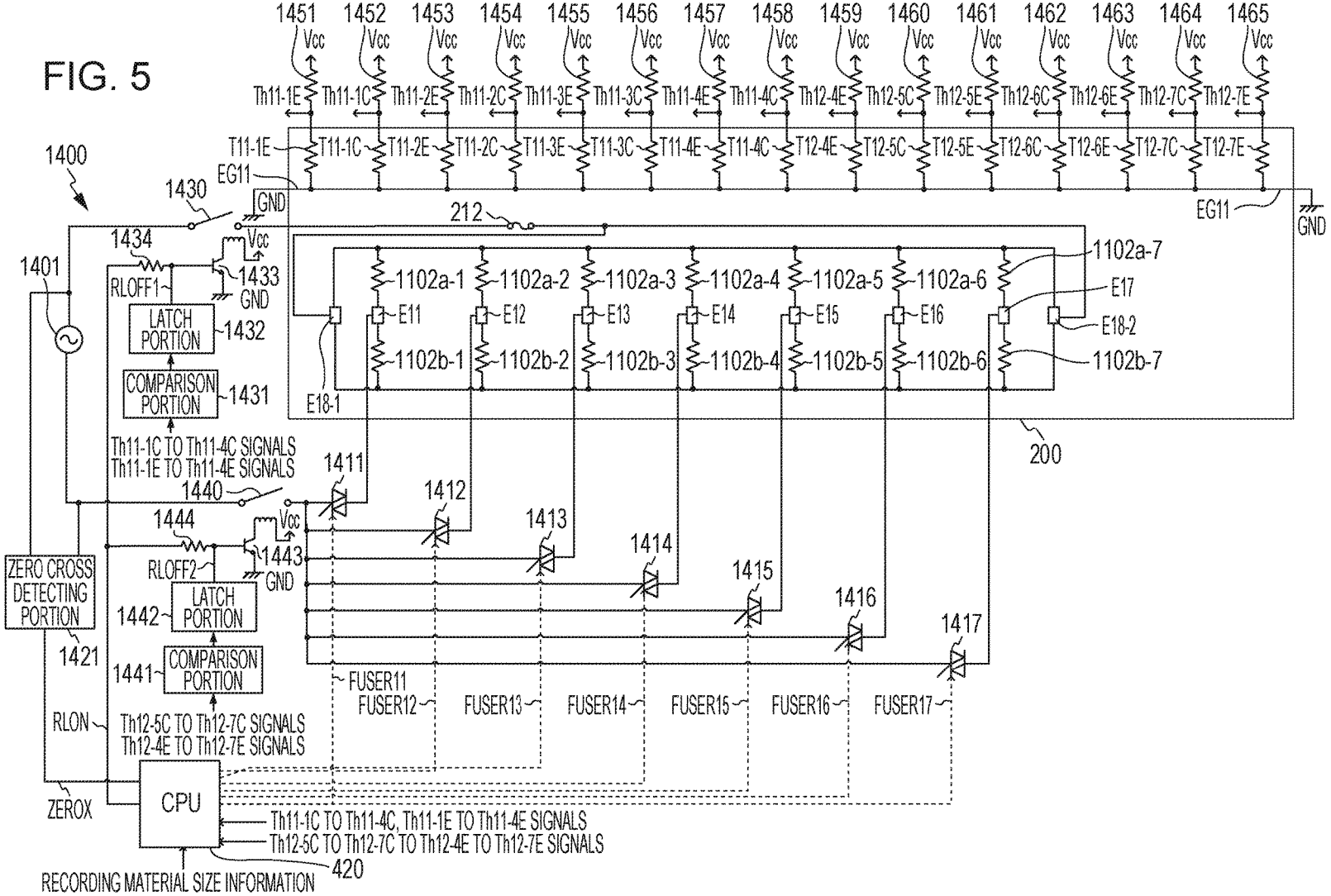
FIG. 5
1400
1401
1430
1431
1432
1433
1434
1440
1441
1442
1443
1444
1411
1412
1413
1414
1415
1416
1417
1421
200
212
420
GND
Vcc
EG11
T11-1E
T11-1C
T11-2E
T11-2C
T11-3E
T11-3C
T11-4E
T11-4C
T12-5E
T12-5C
T12-6E
T12-6C
T12-7E
T12-7C
Th11-1E
Th11-1C
Th11-2E
Th11-2C
Th11-3E
Th11-3C
Th11-4E
Th11-4C
Th12-5E
Th12-5C
Th12-6E
Th12-6C
Th12-7E
Th12-7C
1451
1452
1453
1454
1455
1456
1457
1458
1459
1460
1461
1462
1463
1464
1465
1102a-1
1102a-2
1102a-3
1102a-4
1102a-5
1102a-6
1102a-7
1102b-1
1102b-2
1102b-3
1102b-4
1102b-5
1102b-6
1102b-7
E11
E12
E13
E14
E15
E16
E17
E18-1
E18-2
FUSER11
FUSER12
FUSER13
FUSER14
FUSER15
FUSER16
FUSER17
LATCH PORTION
COMPARISON PORTION
RLOFF1
RLOFF2
Th11-1C TO Th11-4C SIGNALS
Th11-1E TO Th11-4E SIGNALS
Th12-5C TO Th12-7C SIGNALS
Th12-4E TO Th12-7E SIGNALS
CPU
ZERO CROSS DETECTING PORTION
RLON
ZEROX
Th11-1C TO Th11-4C, Th11-1E TO Th11-4E SIGNALS
Th12-5C TO Th12-7C TO Th12-4E TO Th12-7E SIGNALS
RECORDING MATERIAL SIZE INFORMATION

HEATER, IMAGE HEATING DEVICE, AND IMAGE FORMING APPARATUS WHICH MAKES TEMPERATURE DISTRIBUTION OF REGION HEATED BY HEAT GENERATING ELEMENT EVEN

BACKGROUND OF THE INVENTION

Field of the Invention

The present disclosure relates to a heater, an image heating device, and an image forming apparatus.

Description of the Related Art

As an image heating device, there is a device that has a tubular film, a heater which is in contact with an inner surface of the film, and a roller which forms a nip portion with the heater via the film. In an image forming apparatus of an electrophotographic system in which the image heating device is mounted as a fixing device, when fixing processing is continuously performed on recording materials each of which has a size smaller than a maximum sheet passing width in a direction orthogonal to a conveyance direction of the recording material, so-called temperature rise of a non-sheet-passing portion is caused. That is, a phenomenon that temperature of each part in a region (non-sheet-passing portion) through which no recording material passes in a longitudinal direction of a fixing nip portion gradually rises is caused. An image heating device is required to prevent temperature of the non-sheet-passing portion from exceeding a withstanding temperature limit of each member in the device. Therefore, a method of suppressing the temperature rise of the non-sheet-passing portion by reducing throughput (the number of sheets for which printing can be performed per one minute) (throughput down) of continuous printing is often used.

As a method of suppressing the temperature rise of the non-sheet-passing portion, a device in which a heat generating resistor on a heater is divided into a plurality of groups (heating blocks) in a longitudinal direction of the heater and heat generation distribution of the heater is switched in accordance with a size of a recording material is proposed (Japanese Patent Laid-Open No. 2014-59508).

However, temperature distribution of one heating block is affected by a heat generation state of another heating block. Particularly, temperature of an edge region of the one heating block in the longitudinal direction of the heater is affected by a heat generation state or a temperature state of an adjacent heating block. As a result, the temperature distribution in the one heating block becomes uneven, causing a possibility of fixing failure of a toner image.

SUMMARY OF THE INVENTION

The disclosure has been made in view of the aforementioned circumstances, and makes temperature distribution of a heated region that is heated by a heat generating element (heating block) provided in a heater even and suppresses generation of an image defect.

An aspect of the disclosure is a heater that is used for an image heating device. The heater includes a substrate; and a plurality of heating blocks that are provided on the substrate and generate heat upon power supply, the plurality of heating blocks being arrayed along a longitudinal direction of the heater and being able to independently generate heat, in which a plurality of temperature detection elements are provided in at least one of the plurality of heating blocks, in a case where only one of the heating blocks, in which the plurality of temperature detection elements are provided, is caused to generate heat, temperature distribution of the heating block, in which the plurality of temperature detection elements are provided, in the longitudinal direction is inclined so as to be lowered as being closer to both edges, and one of the plurality of temperature detection elements is arranged in an inclination region in which the temperature distribution is inclined.

Another aspect of the disclosure is a heater that is used for an image heating device that includes a substrate; a plurality of heating blocks that are provided on the substrate and generate heat upon power supply, the plurality of heating blocks being arrayed along a longitudinal direction of the heater and being able to independently generate heat; and a temperature detection element that is provided on the substrate, in which a gap is provided between adjacent heating blocks and the temperature detection element is provided in a region of the gap.

Still another aspect of the disclosure is an image heating device that heats an image formed on a recording material. The image heating device includes a film that has a tubular shape; a heater that is in contact with an inner surface of the film; and a control portion that controls power to be supplied to the heater, in which the heater includes: a substrate; and a plurality of heating blocks that are provided on the substrate and generate heat upon power supply, the plurality of heating blocks being arrayed along a longitudinal direction of the heater and being able to independently generate heat, a plurality of temperature detection elements are provided in at least one of the plurality of heating blocks, in a case where only one of the heating blocks, in which the plurality of temperature detection elements are provided, is caused to generate heat, temperature distribution of the heating block, in which the plurality of temperature detection elements are provided, in the longitudinal direction is inclined so as to be lowered as being closer to both edges, and one of the plurality of temperature detection elements is arranged in an inclination region in which the temperature distribution is inclined.

Further features and aspects of the disclosure will become apparent from the following description of multiple example embodiments with reference to the attached drawings.

BRIEF DESCRIPTION OF THE DRAWINGS

FIG. 5 is a circuit diagram of a control circuit of the heater of the example embodiment 1.

DESCRIPTION OF THE EMBODIMENTS

Hereinafter, various modes to implement the disclosure will be described in detail with multiple example embodiments with reference to drawing. Note that, dimensions, materials, shapes, and relative arrangement of components described in the example embodiments are to be appropriately modified in accordance with a configuration of an apparatus to which the disclosure is applied and various conditions, and the scope of the disclosure is not intended to be limited to the following example embodiments.

Examples of an image forming apparatus to which the disclosure can be applied include a copier, a printer, and a multifunction peripheral having functions of them which use an electrophotographic system or an electrostatic recording system, and a case where the disclosure is applied to a laser printer will be described here. Moreover, examples of an image heating device include a fixing device that fixes an unfixed toner image (developer image) on a recording material onto the recording material and a glossing device that improves, by heating a fixed toner image on a recording material again, gloss of the toner image.

Note that, in the present example embodiment, a longitudinal direction of a heater or a substrate, each of which is described below, is a direction same as a direction (width direction of a recording material P) orthogonal to a conveyance direction of the recording material P. In addition, a direction of the heater or the substrate, which is orthogonal to the longitudinal direction, is simply referred to as a transverse direction in some cases. Moreover, in an image forming apparatus of the present example embodiment, conveyance is performed with the center as a reference, and a recording material is conveyed so that a central line in a width direction thereof goes along a conveyance reference position X (refer to FIG. 3) of the image forming apparatus. Moreover, when a recording material is conveyed by a fixing nip portion N described below, a region of the fixing nip portion N, through which the recording material passes, is referred to as a sheet passing region (passing region), and a region of the fixing nip portion N, through which the recording material does not pass, is referred to as a non-sheet-passing region (non-passing region).

(Example Embodiment 1)

An example embodiment 1 will be described below.

Figure 1:
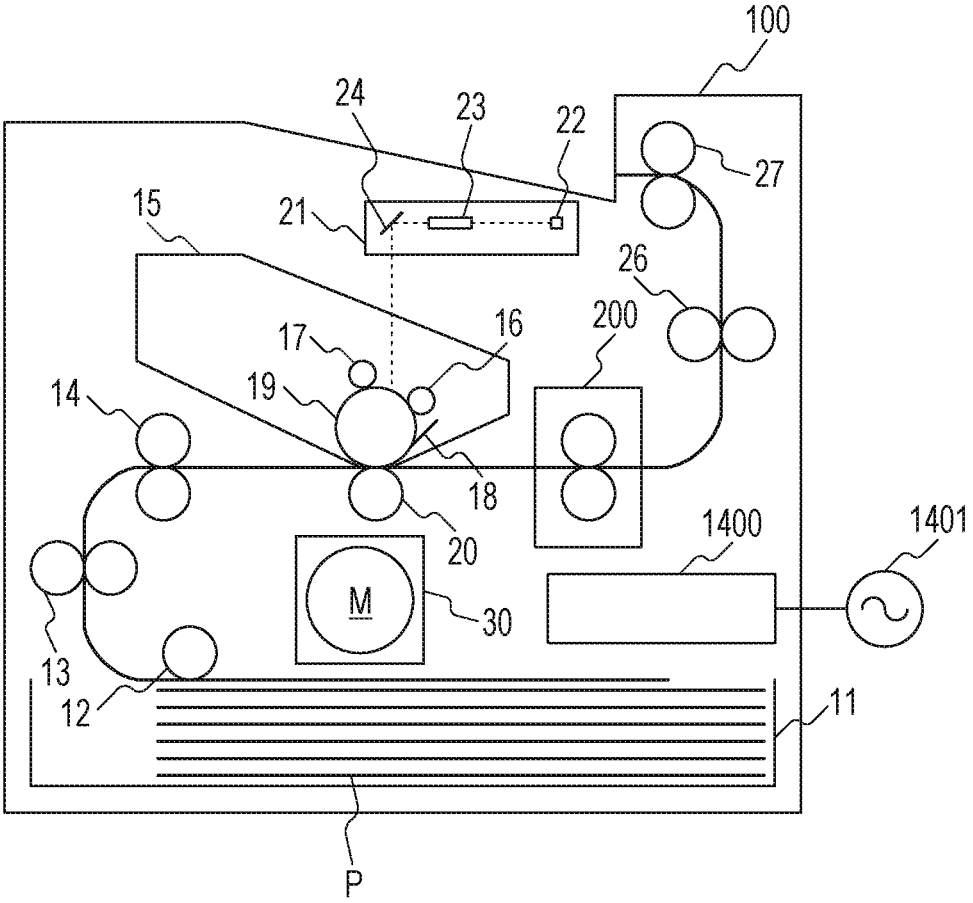
FIG. 1 is a schematic cross sectional view of an image forming apparatus of an example embodiment 1.

FIG. 1 is a schematic cross sectional view of an image forming apparatus 100 of an electrophotographic system according to the present example embodiment.

First, an image forming operation by the image forming apparatus 100 will be described. When a print signal is generated, a scanner unit 21 emits laser light that is modulated in accordance with image information, and scans a photoreceptor 19 that has been charged to a predetermined polarity by a charging roller 16. Thereby, an electrostatic latent image is formed on a surface of the photoreceptor 19. Toner is supplied to the electrostatic latent image from a developing roller 17, and a toner image corresponding to the image information is formed on the photoreceptor 19. On the other hand, recording materials P loaded on a feeding cassette 11 are fed by a pickup roller 12 one by one, and conveyed toward a registration roller pair 14 by a conveyance roller pair 13. Further, each of the recording materials P is conveyed from the registration roller pair 14 to a transfer position so as to match timing at which the toner image on the photoreceptor 19 reaches the transfer position that is formed by the photoreceptor 19 and a transfer roller 20. The toner image on the photoreceptor 19 is transferred onto the recording material P during a process in which the recording material P passes through the transfer position. Thereafter, the recording material P is heated by a fixing unit 200, and the toner image is heated and fixed to the recording material P. The recording material P that bears the fixed toner image is discharged, by conveyance roller pairs 26 and 27, to a tray in an upper portion of the image forming apparatus 100.

In this case, a cleaner 18 that cleans the photoreceptor 19, a light source 22, a polygon mirror 23, a reflection mirror 24, and a motor 30 that drives the fixing unit 200 and the like are provided. A control circuit 1400 connected to a commercial alternating current power supply 1401 supplies power to the fixing unit 200. The photoreceptor 19, the charging roller 16, the scanner unit 21, the developing roller 17, and the transfer roller 20 that are described above constitute an image forming unit configured to form an unfixed image on the recording material P. Moreover, the control circuit 1400 is provided with an electrification control unit configured to control power to be supplied to the fixing unit 200 and a conveyance control unit configured to control conveyance of the recording material P.

Moreover, in the present example embodiment, a unit including the photoreceptor 19 and the cleaner 18 and a unit including the charging roller 16 and the developing roller 17 are integrated and configured as a process cartridge 15 that is detachably attachable to an apparatus main body of the image forming apparatus 100.

The image forming apparatus 100 of the present example embodiment is adapted to a plurality of sizes of recording materials. It is possible to set Letter paper (approximately 216 mm×279 mm) and Legal paper (approximately 216 mm×356 mm) in the feeding cassette 11. Furthermore, A4 paper (210 mm×297 mm), Executive paper (approximately 184 mm×267 mm), and A5 paper (148 mm×210 mm) are able to be set.

Moreover, the image forming apparatus 100 of the present example embodiment is a laser printer that basically performs short edge feeding for the recording material P (conveys the recording material P so that a long side thereof is in parallel to the conveyance direction), but the disclosure is applicable also to a printer that performs long edge feeding for the recording material P. A recording material P whose size is the largest (whose width is the widest) among widths of standardized recording materials P (widths of recording materials in a catalog) to which the image forming apparatus 100 is adapted is Letter paper and Legal paper each of which has a width of approximately 216 mm.

Figure 2:
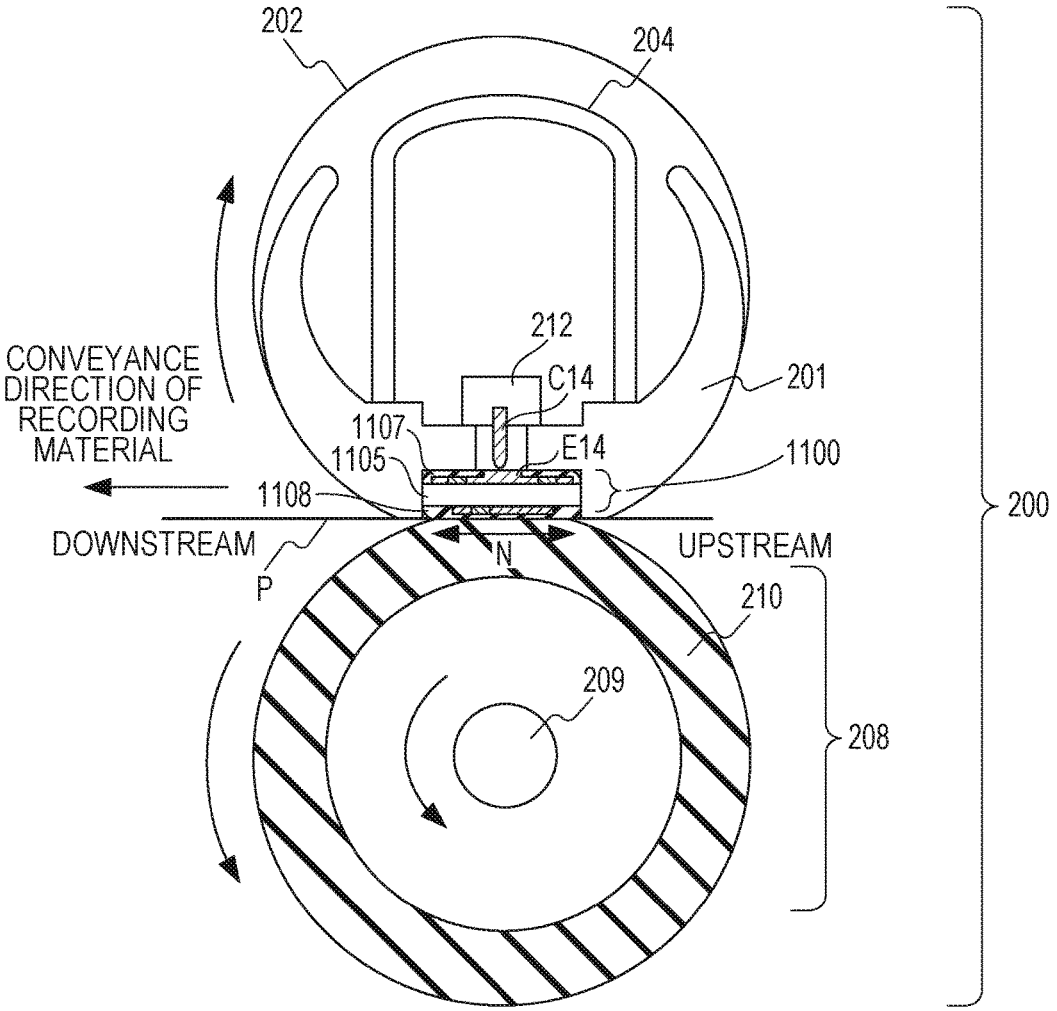
FIG. 2 is a schematic cross sectional view of an image heating device of the example embodiment 1.

Next, the fixing unit 200 in the present example embodiment will be described with reference to FIG. 2. FIG. 2 is a schematic cross sectional view of the fixing unit 200. The cross sectional view is obtained by cutting the fixing unit 200 along the conveyance direction of the recording material P at the conveyance reference position X in the image forming apparatus 100.

The fixing unit 200 has a film 202 that has a tubular shape, a heater 1100 that is in contact with an inner surface of the film 202, and a pressure roller (nip portion forming member) 208 that forms the fixing nip portion N together with the heater 1100 via the film 202. In this case, the film 202 and the pressure roller 208 constitute a conveyance portion that conveys a recording material. A material of a base layer of the film 202 is heat-resistant resin such as a polyimide or metal such as stainless steel. Moreover, the film 202 may be provided with an elastic layer such as heat-resistant rubber. The pressure roller 208 includes a metal core 209 whose material is iron, aluminum, or the like and an elastic layer 210 whose material is silicone rubber or the like.

The heater 1100 is held by a holding member 201 that is made of heat-resistant resin such as a liquid crystal polymer. The holding member 201 also has a guiding function for guiding rotation of the film 202. The pressure roller 208 receives motive power from a motor 30 and thereby rotates in an arrow direction of FIG. 2. When the pressure roller 208 rotates, the film 202 is driven to rotate. The recording material P that bears an unfixed toner image is heated while being pinched and conveyed by the fixing nip portion N, and subjected to fixing processing. In this manner, the fixing unit 200 has the film 202 that has the tubular shape and the heater 1100 that is in contact with the inner surface of the film 202, and heats, by heat of the heater 1100 via the film 202, an image that is formed on the recording material P.

The heater 1100 which will be described below in detail by using FIGS. 3A, 3B, and 3C includes a substrate 1105 that is made of ceramics and a heat generating resistor (heat generating element) that is provided on the substrate 1105 and generates heat by electrification. On a surface (first surface) of the substrate 1105, which is on a side of the fixing nip portion N and in contact with the film 202, a surface protecting layer 1108 that is made of glass is provided in order to secure slidability of the film 202. On a surface (second surface) of the substrate 1105, which is opposite to the first surface on the side of the fixing nip portion N, a surface protecting layer 1107 that is made of glass is provided in order to insulate the heat generating resistor. An electrode E14 is exposed on the second surface, and when an electric contact C14 for power supply comes in contact with the electrode E14, the heat generating resistor is electrically connected to the alternating current power supply 1401.

A protection element 212 such as a thermal switch or a temperature fuse operates due to abnormal heat generation and intercepts power to be supplied to the heater 1100. The protection element 212 abuts on the heater 1100 or is arranged with a little gap with respect to the heater 1100. A stay 204 that is made of metal is used for applying pressure of a spring (not illustrated) to the holding member 201, and also has a function of reinforcing the holding member 201 and the heater 1100.

Figure 3A:
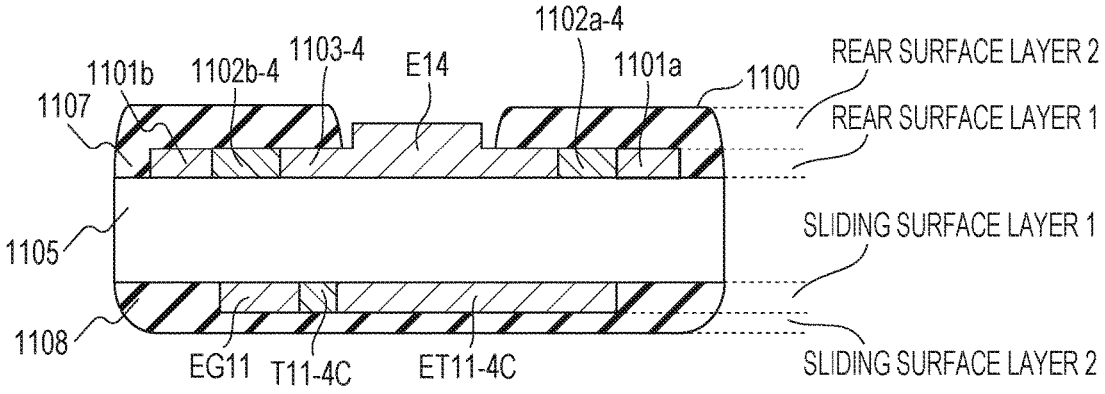
FIGS. 3A, 3B, and 3C are views each illustrating a configuration of a heater of the example embodiment 1.
Figure 3B:
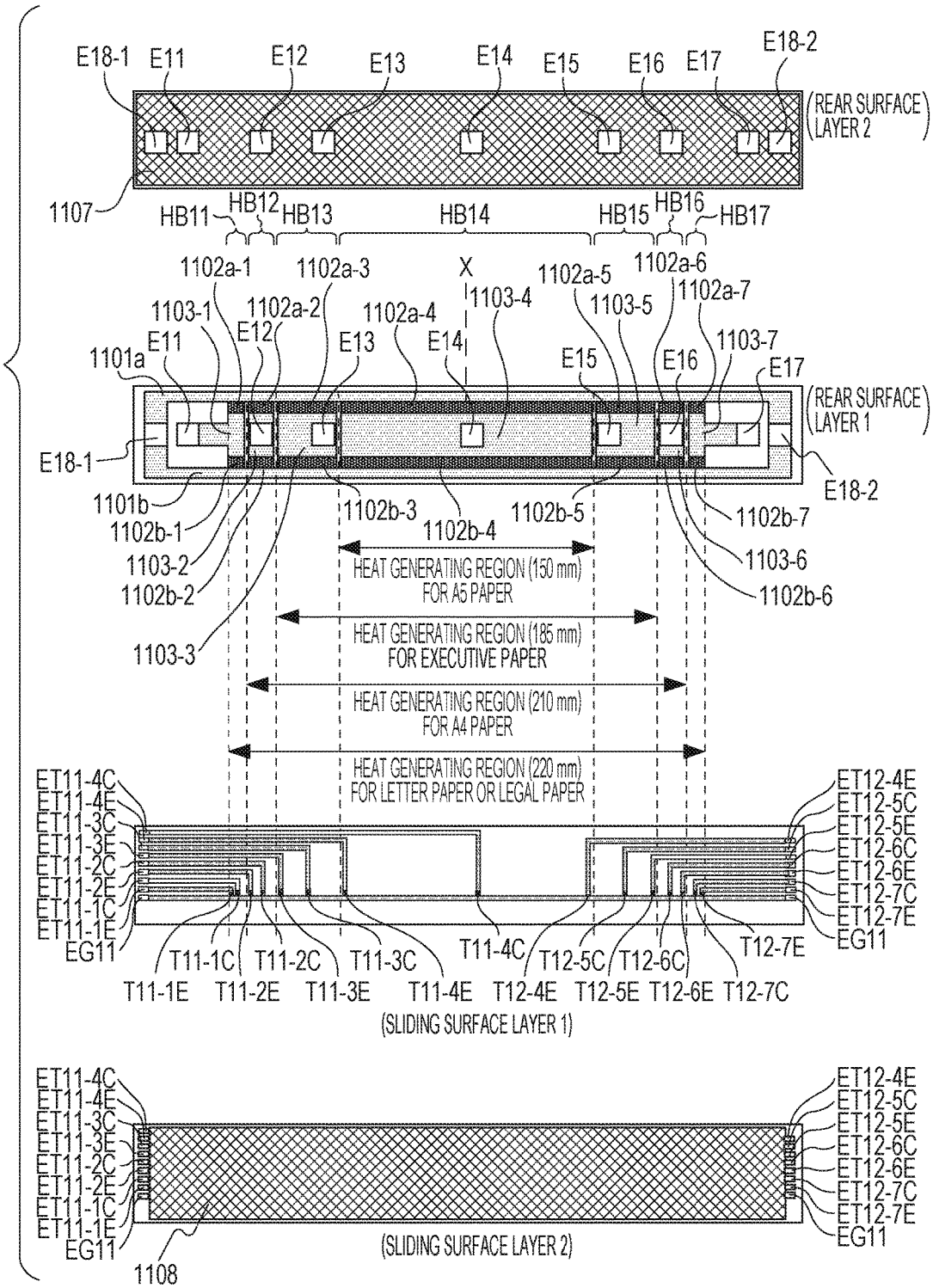
Figure 3C:
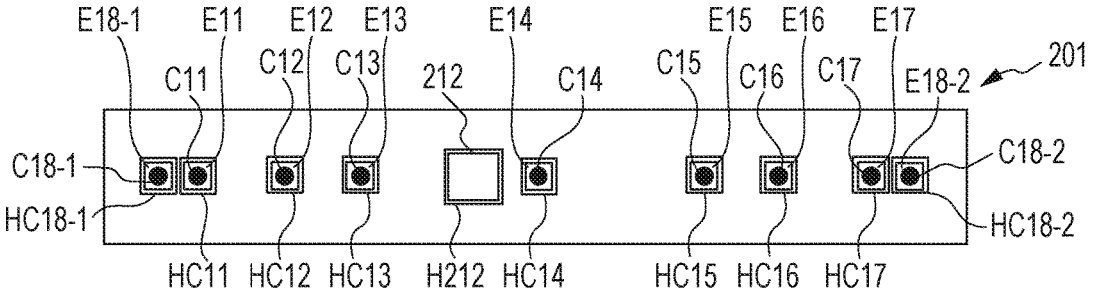

FIGS. 3A and 3B are views each illustrating a configuration of the heater 1100 of the present example embodiment. FIG. 3A illustrates a schematic cross sectional view of the heater 1100 near the conveyance reference position X of the recording material P, which is illustrated in FIG. 3B. FIG. 3B illustrates a schematic plan view of respective layers of the heater 1100. FIG. 3C is a schematic plan view of the holding member 201 that holds the heater 1100.

Next, the configuration of the heater 1100 will be described.

The heater 1100 is constituted by the substrate 1105, a sliding surface layer 1 that is provided on a side of the first surface of the substrate 1105, which comes in contact with the film 202, a sliding surface layer 2 that covers the sliding surface layer 1, a rear surface layer 1 that is provided on a side of the second surface of the substrate 1105, and a rear surface layer 2 that covers the rear surface layer 1. On the rear surface layer 1 of the heater 1100, a plurality of heating blocks each of which is formed of a combination of a first conductive element (conductive element A) 1101, a second conductive element (conductive element B) 1103, and a heat generating resistor (heat generating element) 1102 are provided along the longitudinal direction thereof. The heater 1100 of the present example embodiment has seven heating blocks HB11 to HB17 in total. Independent control of the heating blocks HB11 to HB17 will be described below.

A plurality of first conductive elements 1101 are provided on the substrate 1105 along the longitudinal direction thereof, and a plurality of second conductive elements 1103 are provided on the substrate 1105 along the longitudinal direction at positions which are different in a transverse direction from those of the first conductive elements 1101. Each of heat generating resistors 1102 is provided between each of the first conductive elements 1101 and each of the second conductive elements 1103 (between paired conductive elements), and generates heat by power supplied via the first conductive element 1101 and the second conductive element 1103.

The heat generating resistors 1102 of the respective heating blocks are divided into heat generating resistors 1102*a* and heat generating resistors 1102*b* that are formed at positions which are mutually symmetrical about the center of the substrate 1105 in a transverse direction of the heater 1100. Moreover, the first conductive elements 1101 are divided into conductive elements 1101*a* which are connected to the heat generating resistors 1102*a* and conductive elements 1101*b* which are connected to the heat generating resistors 1102*b*.

Since the heater 1100 has the seven heating blocks HB11 to HB17, the heat generating resistors 1102*a* are divided into seven heat generating resistors 1102*a*-1 to 1102*a*-7. Similarly, the heat generating resistors 1102*b* are divided into seven heat generating resistors 1102*b*-1 to 1102*b*-7. Furthermore, the second conductive elements 1103 are also divided into seven second conductive elements 1103-1 to 1103-7. Note that, the heat generating resistors 1102*a*-1 to 1102*a*-7 are arranged in the substrate 1105 on an upstream side of the conveyance direction of the recording material P, and the heat generating resistors 1102*b*-1 to 1102*b*-7 are arranged in the substrate 1105 on a downstream side of the conveyance direction of the recording material P.

On the rear surface layer 2 of the heater 1100, the surface protecting layer 1107 that covers the heat generating resistors 1102, the first conductive elements 1101, and the second conductive elements 1103 and is insulating (in the present example embodiment, made of glass) is provided. However, the surface protecting layer 1107 covers none of electrodes E11 to E17, E18-1, and E18-2 with which electric contacts C11 to C17, C18-1 and C18-2 for power supply are respectively in contact. The electrodes E11 to E17 are electrodes for supplying power to the heating blocks HB11 to HB17 via the second conductive elements 1103-1 to 1103-7, respectively. The electrodes E18-1 and E18-2 are electrodes for supplying power to the heating blocks HB11 to HB17 via the first conductive elements 1101*a* and 1101*b*.

By the way, since a resistance value of each of the conductive elements is not zero, there is a concern that heat generation distribution in the longitudinal direction of the heater 1100 is affected. Then, the electrodes E18-1 and E18-2 are separately provided in both ends of the heater 1100 in the longitudinal direction so that the heat generation distribution does not become uneven even when being affected by electric resistance of the first conductive elements 1101*a* and 1101*b* and the second conductive elements 1103-1 to 1103-7.

As illustrated in FIG. 2, the protection element 212 and the electric contacts C11 to C17, C18-1, and C18-2 are provided in a space between the stay 204 and the holding member 201. As illustrated in FIG. 3C, holes HC11 to HC17, HC18-1, and HC18-2 through which the electric contacts C11 to C17, C18-1, and C18-2 that are respectively connected to the electrodes E11 to E17, E18-1, and E18-2 respectively pass are provided in the holding member 201. Moreover, the holding member 201 is provided also with a hole H212 through which a heat sensing portion of the protection element 212 passes. The electric contacts C11 to C17, C18-1, and C18-2 are electrically connected to corresponding electrodes by a method such as urging of a spring or welding. The protection element 212 is also urged by a spring, and a heat sensing portion thereof is in contact with the surface protecting layer 1107. Each of the electric contacts C11 to C17, C18-1, and C18-2 is connected to the control circuit 1400 of the heater 1100 via a conductive member, such as a cable or a thin metal plate, which is provided in the space between the stay 204 and the holding member 201.

By providing the electrodes E11 to E17, E18-1, and E18-2 on a rear surface of the heater 1100, it is not necessary to provide, on the substrate 1105, a region for a wiring to make electrical connection with each of the second conductive elements 1103-1 to 1103-7. It is therefore possible to shorten a width of the substrate 1105 in the transverse direction, thus making it possible to suppress an increase in a size of the heater 1100. Note that, as illustrated in FIG. 3B, the electrodes E12 to E16 are provided in a region in which the heat generating resistors 1102 are provided in the longitudinal direction of the substrate 1105.

As described below, the heater 1100 of the present example embodiment is able to form various types of heat generation distribution by independently controlling the plurality of heating blocks HB11 to HB17. It is thereby possible to set heat generation distribution according to a size of a recording material. Further, the heat generating resistors 1102 are formed of a material having a PTC (Positive Temperature Coefficient). By using the material having the PTC, it is possible to suppress temperature rise of a non-sheet-passing portion, even in a case where an edge of a recording material and a boundary between the heating blocks are not coincident with each other.

On the sliding surface layer 1 on a side of a sliding surface (surface on a side that is in contact with the film 202) of the heater 1100, a plurality of thermistors (temperature detection elements) for detecting temperature of each of the heating blocks HB11 to HB17 are formed. In FIG. 3B, the plurality of thermistors are indicated by reference signs of T11-1C to T11-4C, T11-1E to T11-4E, T12-5C to T12-7C, and T12-4E to T12-7E. A material of the thermistors is only required to be a material whose TCR (Temperature Coefficient of Resistance) is positively or negatively great. In the present example embodiment, each of the thermistors is formed by thinly printing a material having an NTC (Negative Temperature Coefficient) on the substrate 1105. In the present example embodiment, two or more thermistors are arranged for each of all the heating blocks HB11 to HB17 as illustrated in FIG. 3B. Therefore, even when one of the plurality of thermistors that deal with one heating block malfunctions, it is possible to detect temperature of the heating block by using another thermistor. Thus, the heater 1100 is configured so that temperature detection in all the heating blocks HB11 to HB17 is less likely to be not allowed.

Hereinafter, arrangement of the thermistors with respect to each of the heating blocks HB11 to HB17 will be described.

In the present example embodiment, a configuration in which two or more thermistors are arranged for one heating block is adopted as illustrated in FIG. 3B. For example, it is configured so that two thermistors T12-5C and T12-5E are provided for the heating block HB15 and able to respectively detect temperature by conductive patterns for resistance value detection ET12-5C and ET12-5E and a common conductive pattern EG11. The thermistor T12-5C is a main thermistor by which temperature of a center region of the heating block HB15 is detected, and arranged in a substantially center part of a region (range) of the heating block HB15 in the longitudinal direction of the heater 1100. Moreover, the thermistor T12-5E is an edge thermistor by which temperature of an edge region of the heating block HB15 is detected, and arranged in the region of the heating block HB15 on a side which is adjacent to the heating block HB16 in the longitudinal direction of the heater 1100. In this manner, main thermistors T11-1C to T11-4C and T12-5C to T12-7C that respectively detect temperature of center regions of the heating blocks HB11 to HB17 are arranged. Moreover, edge thermistors T11-1E to T11-4E and T12-4E to T12-7E that respectively detect temperature of edge regions of the heating blocks HB11 to HB17 are arranged.

On the sliding surface layer 2 of the heater 1100, in order to secure slidability of the film 202, the surface protecting layer 1108 that is insulating (in the present example embodiment, made of glass) is formed by coating. The surface protecting layer 1108 covers the main thermistors T11-1C to T11-4C and T12-5C to T12-7C, the edge thermistors T11-1E to T11-4E and T12-4E to T12-7E, conductive patterns, and the common conductive pattern EG11. However, in order to secure connection with electric contacts, a part of the conductive patterns and a part of the common conductive pattern EG11 are exposed at both ends of the heater 1100 as illustrated in FIG. 3B.

Figure 4A:
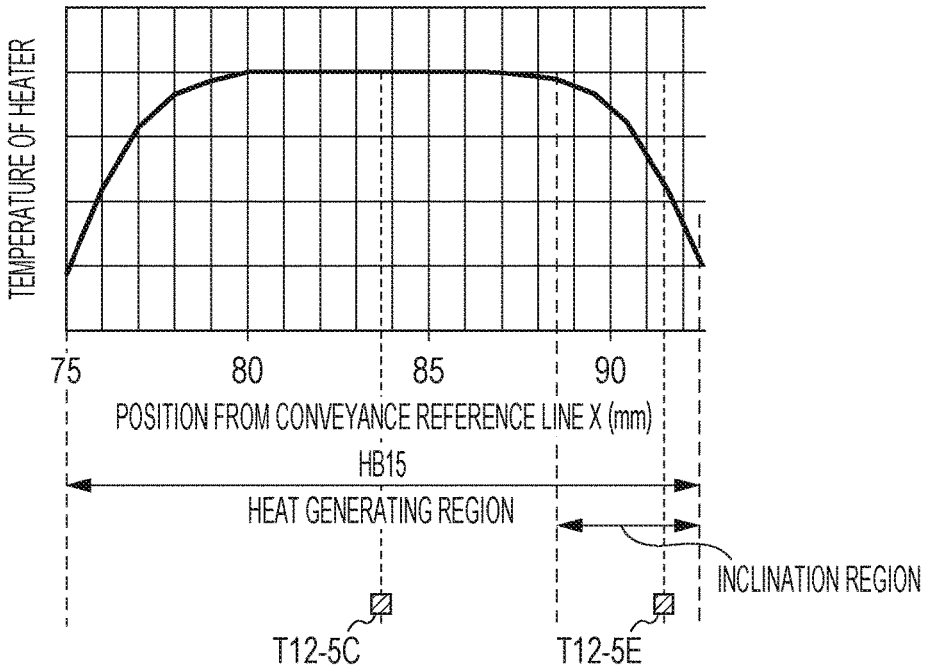
FIGS. 4A and 4B are views each illustrating temperature distribution in a longitudinal direction of the heater and arrangement of thermistors of the example embodiment 1.
Figure 4B:
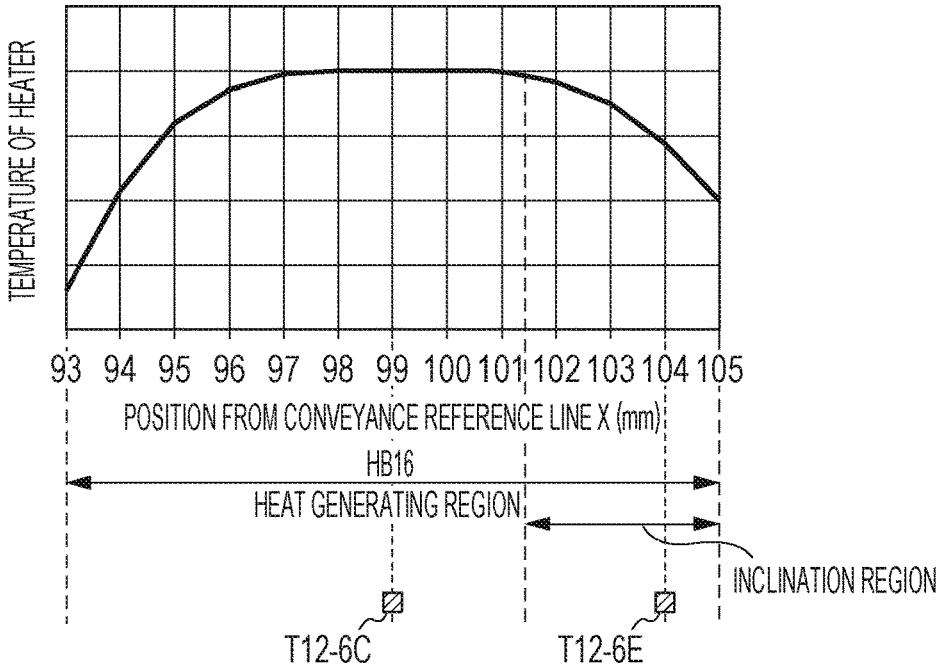

FIGS. 4A and 4B are views each illustrating temperature distribution in the longitudinal direction of the heater 1100 and detailed arrangement of the thermistors. FIG. 4A is an illustration about the heating block HB15, and FIG. 4B is an illustration about the heating block HB16.

FIG. 4A illustrates temperature distribution of a region (heated region) on a sliding surface layer side of the heater 1100 when the heating block HB15 is caused to generate heat alone from normal temperature (25° C.). A heat generating region of the heating block HB15 is a region whose distance from the conveyance reference line X in the longitudinal direction is 75 mm to 92.5 mm. As illustrated in FIG. 4A, in a case where the heating block HB15 is caused to generate heat alone, heat is transferred to regions of the heating blocks HB14 and HB16 which are in proximity thereto and are not caused to generate heat, so that temperature of edge regions of the heating block HB15 is lowered.

In the present example embodiment, a region in which, when the heating block HB15 is caused to generate heat alone, temperature is low compared with temperature of a vicinity of the center of the heating block HB15 in a longitudinal direction as above is defined as an inclination region. Then, it is characterized in that the edge thermistor T12-5E is arranged in the inclination region (at a position where the temperature of the inclination region is detected). More specifically, as illustrated in FIG. 4A, the inclination region is a region in which an inclination in the temperature distribution in the longitudinal direction exists in the heated region that is heated when the heating block HB15 is caused to generate heat alone. Here, the heated region is a region (including a region of the sliding surface layer 1) on the sliding surface side of the heater 1100.

When the inclination region is defined further specifically, first, in a state where the heater 1100 is adapted to an environment in which room temperature is 25° C. and humidity is 65%, power is supplied to only one heating block. The supplied power at this time is power of 2 W per unit length (2 W/mm) in the longitudinal direction of the heater 1100. For example, when being supplied to the heating block HB15, the supplied power is 50 W, and when being supplied to the heating block HB16, the supplied power is 24 W. Then, when temperature of the main thermistor (in a case of supplying power to the heating block HB15, the thermistor T12-5C) reaches 200° C., a region in which the temperature is not more than 195° C. in the heating block is set as the inclination region. The inclination region of each of the heating blocks HB11 to HB17 is obtained by causing all the heating blocks to generate heat one by one in the state of being adapted to the environment in which room temperature is 25° C. and humidity is 65%.

The main thermistor T12-5C is arranged at a position where temperature of a region in which the temperature distribution in the longitudinal direction of the heater 1100 is flat (even) is detected in the heated region heated when the heating block HB15 is caused to generate heat alone. In the present example embodiment, the main thermistor T12-5C is arranged in the center region of the heating block HB15 in the longitudinal direction of the heater 1100.

In the present example embodiment, as illustrated in FIGS. 3A and 3B, each of the thermistors is arranged in a region in the sliding surface layer 1 of the heater 1100. A position thereof is a position at which, in the longitudinal direction of the heater 1100, the thermistor is overlapped with the heat generating resistor constituting the corresponding heating block. Moreover, a region of the heating block in the longitudinal direction is overlapped with a region, in the longitudinal direction of the heater 1100, of the heat generating resistor constituting the heating block (the regions are the same).

Similarly, FIG. 4B illustrates temperature distribution of a region on the sliding surface layer side of the heater 1100 when the heating block HB16 is caused to generate heat alone from normal temperature (25° C.). A heat generating region of the heating block HB16 is a region whose distance from the conveyance reference line X in the longitudinal direction is 93 mm to 105 mm.

As illustrated in FIG. 4B, in a case where the heating block HB16 is caused to generate heat alone, heat is transferred to regions of the heating blocks HB15 and HB17 which are in proximity thereto and are not caused to generate heat, so that temperature of edge regions of the heating block HB16 is lowered. Similarly to the heating block HB15, the edge thermistor T12-6E is arranged in the inclination region illustrated in FIG. 4B also in the heating block HB16. Moreover, the main thermistor T12-6C is arranged in a center region of the heating block HB16 in the longitudinal direction.

As above, in the present example embodiment, the main thermistor and the edge thermistor are arranged for each of the heating blocks HB15 and HB16.

Each of the edge thermistors T12-5E and T12-6E in the present example embodiment is arranged in a region which is in the inclination region and whose distance from an edge of the heating block in the longitudinal direction of the heater 1100 is 1 mm. However, there is no limitation thereto, and each of the edge thermistors T12-5E and T12-6E is only required to be arranged in the inclination region.

Moreover, although each of the main thermistors T12-5C and T12-6C is arranged in the center region of each of the heating blocks HB15 and HB16 in the longitudinal direction of the heater 1100, there is no limitation thereto. Each of the main thermistors T12-5C and T12-6C is only required to be arranged in a region in which the temperature distribution in the longitudinal direction of the heater 1100 is flat in the heated region heated when the heating block is caused to generate heat alone, and arranged at a position where temperature of the heating block is able to be detected representatively.

As above, although description has been given for the heating blocks HB15 and HB16, the main thermistor and the edge thermistor are arranged at similar positions also in each of the other heating blocks HB11, HB12, HB13, HB14, and HB17.

FIG. 5 is a circuit diagram of the control circuit 1400 that controls the heater 1100.

Power control (electrification control) for the heater 1100 is performed by electrifying/intercepting, by triacs 1411 to 1417, power supply to the heater 1100. The triacs 1411 to 1417 operate in accordance with FUSER11 to FUSER17 signals from a CPU 420, respectively. The control circuit 1400 of the heater 1100 has a circuit configuration that is able to independently perform electrification control of the seven heating blocks HB11 to HB17 by the seven triacs 1411 to 1417. Note that, a driving circuit of each of the triacs 1411 to 1417 is omitted in FIG. 5.

A zero cross detecting portion 1421 is a circuit that detects zero cross of the alternating current power supply 1401, and outputs a ZEROX signal to the CPU 420. The ZEROX signal is used, for example, as a reference signal with which phase control of the triacs 1411 to 1417 is performed.

Next, a temperature detection method of the heater 1100 will be described.

Signals (Th11-1C to Th11-4C, Th11-1E to Th11-4E, Th12-5C to Th12-7C, and Th12-4E to Th12-7E) that are obtained by dividing a voltage Vcc by resistance values of the thermistors and resistance values of resistances 1451 to 1465 are input to the CPU 420. Here, the thermistors are indicated by reference signs of T11-1C to T11-4C, T11-1E to T11-4E, T12-5C to T12-7C, and T12-4E to T12-7E in FIG. 5. For example, the signal Th11-4C is a signal obtained by dividing the voltage Vcc by the resistance value of the thermistor T11-4C and the resistance value of the resistance 1458. Since the thermistor T11-4C has the resistance value according to temperature, when temperature of the heating block HB14 changes, a level of the signal Th11-4C to be input to the CPU 420 also changes. The CPU 420 converts each of the input signals into temperature according to a level thereof.

On the basis of setting temperature (control target temperature) of each of the heating blocks and detected temperature (output) of each of the thermistors, the CPU 420 calculates, for example, by PI control, power to be supplied to the heater 1100. Furthermore, the CPU 420 converts the calculated supplied power into control timing such as a phase angle (phase control) or a wave number (wave number control) each of which corresponds thereto, and controls the triacs 1411 to 1417 at the control timing. Since processing of the signals corresponding to the other thermistors is similar, description thereof will be omitted.

Next, power control for the heater 1100 (temperature control of the heater 1100) will be described.

During fixing processing, each of the heating blocks HB11 to HB17 is controlled so that detected temperature of each of the thermistors maintains the setting temperature (control target temperature). Specifically, power to be supplied to the heating block HB14 is controlled by controlling drive of the triac 1414 so that the detected temperature of the thermistor T11-4C maintains the setting temperature. In this manner, each of the thermistors is used when control for keeping temperature of each of the heating blocks HB11 to HB17 constant is executed. Relays 1430 and 1440 are provided as a unit configured to intercept power to the heater 1100 in a case where temperature of the heater 1100 excessively rises due to malfunction of the device or the like.

Next, a circuit operation of the relays 1430 and 1440 will be described.

When an RLON signal output from the CPU 420 is brought into a High state, a transistor 1433 is brought into an ON state, a secondary-side coil of the relay 1430 is electrified from a direct current power supply (voltage Vcc), and a primary-side contact of the relay 1430 is brought into the ON state. When the RLON signal is brought into a Low state, the transistor 1433 is brought into an OFF state, a current flowing to the secondary-side coil of the relay 1430 from the power supply (voltage Vcc) is intercepted, and the primary-side contact of the relay 1430 is brought into the OFF state. Similarly, when the RLON signal is brought into the High state, a transistor 1443 is brought into the ON state, a secondary-side coil of the relay 1440 is electrified from the power supply (voltage Vcc), and a primary-side contact of the relay 1440 is brought into the ON state. When the RLON signal is brought into the Low state, the transistor 1443 is brought into the OFF state, a current flowing to the secondary-side coil of the relay 1440 from the power supply (voltage Vcc) is intercepted, and the primary-side contact of the relay 1440 is brought into the OFF state.

Next, an operation of a protection circuit that uses the relays 1430 and 1440 (hard circuit that does not use the CPU 420) will be described.

When a level of any of the signals Th11-1C to Th11-4C and Th11-1E to Th11-4E exceeds a predetermined value that is set in an inside of a comparison portion 1431, the comparison portion 1431 causes a latch portion 1432 to operate. Thereby, the latch portion 1432 latches an RLOFF1 signal in the Low state. In a case where the RLOFF1 signal is brought into the Low state, even when the CPU 420 brings the RLON signal into the High state, the transistor 1433 is kept in the OFF state, so that the relay 1430 is able to keep the OFF state (safe state). Note that, during a non-latched state, the latch portion 1432 keeps the RLOFF1 signal as an output in an open state.

Similarly, when a level of any of the signals Th12-5C to Th12-7C and Th12-4E to Th12-7E exceeds a predetermined value that is set in an inside of a comparison portion 1441, the comparison portion 1441 causes a latch portion 1442 to operate. Thereby, the latch portion 1442 latches an RLOFF2 signal in the Low state. In a case where the RLOFF2 signal is brought into the Low state, even when the CPU 420 brings the RLON signal into the High state, the transistor 1443 is kept in the OFF state, so that the relay 1440 is able to keep the OFF state (safe state). During the non-latched state, the latch portion 1442 keeps the RLOFF2 signal as an output in the open state. In this case, both the predetermined value set in the inside of the comparison portion 1431 and the predetermined value set in the inside of the comparison portion 1441 in the present example embodiment are set as values corresponding to 300° C.

Figure 6:
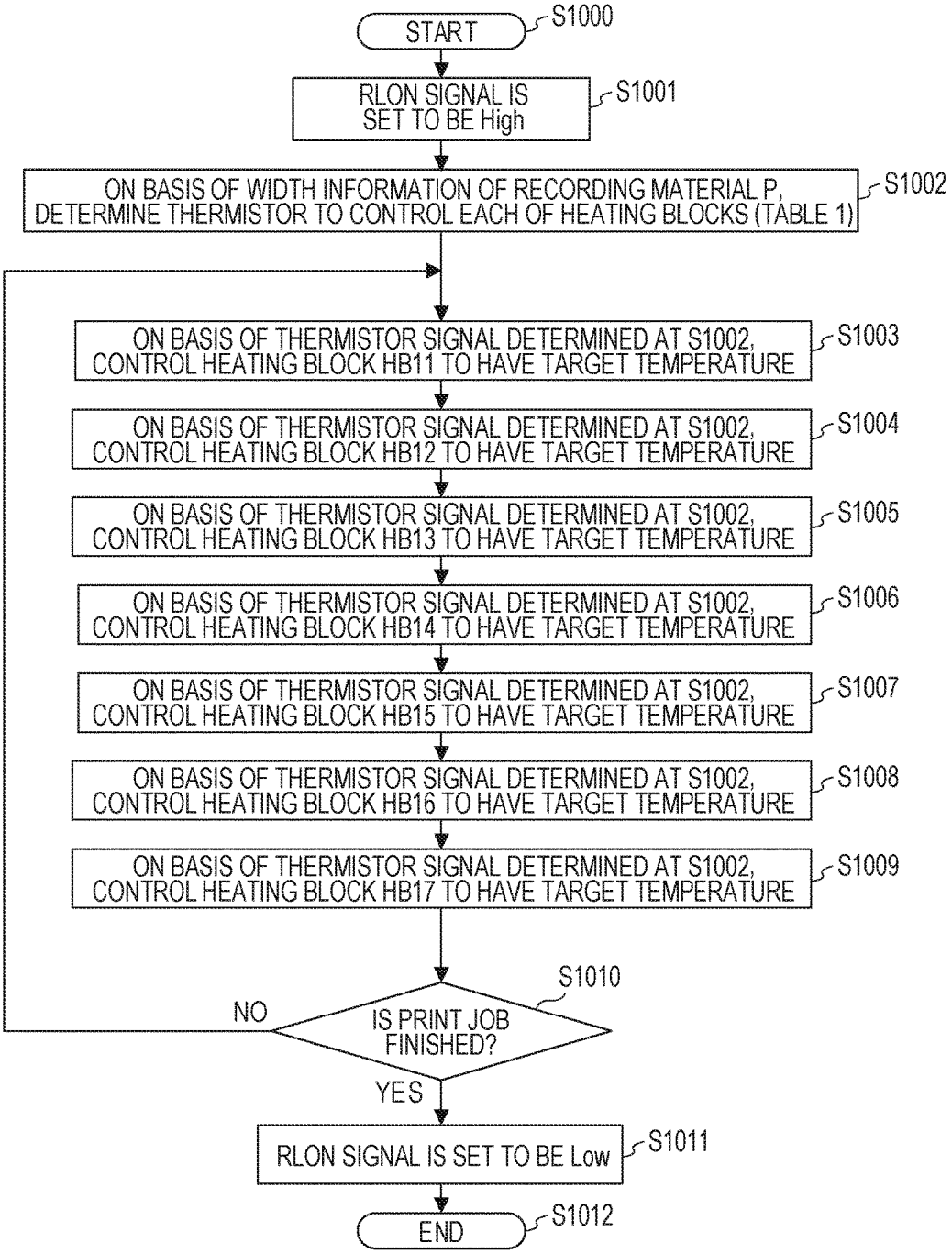
FIG. 6 is a flowchart for explaining control processing of the control circuit by a CPU of the example embodiment 1.

FIG. 6 is a flowchart for explaining a control sequence of the control circuit 1400, which is performed by the CPU 420.

When a print request is generated at S1000, the relays 1430 and 1440 are brought into the ON state at S1001. At S1002, in accordance with width information of the recording material P, the thermistor that is to be used for controlling each of the heating blocks HB11 to HB17 to maintain setting temperature (control target temperature) is determined. Table 1 indicates the thermistor for controlling each of the heating blocks HB11 to HB17 in accordance with a width W of the recording material P.

TABLE 1

| Width W of recording material | HB11 | HB12 | HB13 | HB14 | HB15 | HB16 | HB17 |
|---|---|---|---|---|---|---|---|
| 210 mm < W | T11-1C | T11-2C | T11-3C | T11-4C | T12-5C | T12-6C | T12-7C |
| 185 mm < W ≤ 210 mm | T11-2E | T11-2C | T11-3C | T11-4C | T12-5C | T12-6C | T12-6E |
| 150 mm < W ≤ 185 mm | T11-1C | T11-3E | T11-3C | T11-4C | T12-5C | T12-5E | T12-7C |
| W ≤ 150 mm | T11-1C | T11-2C | T11-4E | T11-4C | T12-4E | T12-6C | T12-7C |

As indicated in Table 1, in a case where the width W of the recording material P satisfies W>210 mm, all of the heating blocks HB11 to HB17 are subjected to electrification control so that detected temperature of the main thermistor of each of the heating blocks HB11 to HB17 maintains the control target temperature. The control target temperature of each of the main thermistors T11-1C to T11-4C and T12-5C to T12-7C in a case of 210 mm<W is 240° C.

In a case where the width W of the recording material P satisfies 185 mm<W≤210 mm, the heating blocks (first heating blocks) HB12 to HB16 that are positioned in a region through which the recording material P passes are subjected to electrification control so that detected temperature of the main thermistor of each of the heating blocks HB12 to HB16 maintains the control target temperature. On the other hand, the heating block HB11 is a heating block (second heating block) which is adjacent to the heating block HB12, which is positioned in a region through which one edge of the recording material P in a width direction passes, and through which the recording material P does not pass. The heating block HB11 is subjected to electrification control so that detected temperature of the edge thermistor T11-2E of the heating block HB12 (first heating block through which the one edge of the recording material P passes) maintains the control target temperature. Similarly, the heating block HB17 is a heating block (second heating block) which is adjacent to the heating block HB16, which is positioned in a region through which the other edge of the recording material P in the width direction passes, and through which the recording material P does not pass. The heating block HB17 is subjected to electrification control so that detected temperature of the edge thermistor T12-6E of the heating block HB16 maintains the control target temperature. The control target temperature of each of the main thermistors T11-2C to T11-4C, T12-5C, and T12-6C in a case of 185 mm<W≤210 mm is 240° C. Moreover, the control target temperature of each of the sub-thermistor T11-2E with which the heating block HB11 is controlled and the sub-thermistor T12-6E with which the heating block HB17 is controlled is also 240° C.

In a case where the width W of the recording material P satisfies 150 mm<W≤185 mm, the heating blocks (first heating blocks) HB13 to HB15 that are positioned in a region through which the recording material P passes are subjected to electrification control so that detected temperature of the main thermistor of each of the heating blocks HB13 to HB15 maintains the control target temperature. On the other hand, the heating block HB12 is a heating block (second heating block) which is adjacent to the heating block HB13, which is positioned in a region through which one edge of the recording material P in the width direction passes, and through which the recording material P does not pass. The heating block HB12 is subjected to electrification control so that detected temperature of the edge thermistor T11-3E of the heating block HB13 (first heating block through which the one edge of the recording material P passes) maintains the control target temperature. Similarly, the heating block HB16 is a heating block (second heating block) which is adjacent to the heating block HB15, which is positioned in a region through which the other edge of the recording material P in the width direction passes, and through which the recording material P does not pass. The heating block HB16 is subjected to electrification control so that detected temperature of the edge thermistor T12-5E of the heating block HB15 maintains the control target temperature. The heating blocks HB11 and HB17 are heating blocks (third heating blocks) through which the recording material P does not pass and which are not adjacent to the heating block HB13 or the heating block HB15 through each of which each of the edges of the recoding material P passes. Each of the heating blocks HB11 and HB17 is subjected to electrification control so that detected temperature of the main thermistor of each of the heating blocks HB11 and HB17 maintains the control target temperature. The control target temperature of each of the main thermistors T11-3C, T11-4C, and T12-5C in a case of 150 mm<W≤185 mm is 240° C. Moreover, the control target temperature of each of the sub-thermistor T11-3E with which the heating block HB12 is controlled and the sub-thermistor T12-5E with which the heating block HB16 is controlled is also 240° C. The control target temperature of each of the main thermistors T11-1C and T12-7C is 170° C.

In a case where the width W of the recording material P satisfies W≤150 mm, the heating block HB14 that is a heating block positioned in a region through which the recording material P passes is subjected to electrification control so that detected temperature of the main thermistor T11-4C maintains the control target temperature. On the other hand, the heating block HB13 is a heating block which is adjacent to the heating block HB14, which is positioned in a region through which one edge of the recording material P in the width direction passes, and through which the recording material P does not pass. The heating block HB13 is subjected to electrification control so that detected temperature of the edge thermistor T11-4E of the heating block HB14 maintains the control target temperature. Similarly, the heating block HB15 is a heating block which is adjacent to the heating block HB14, which is positioned in a region through which the other edge of the recording material P in the width direction passes, and through which the recording material P does not pass. The heating block HB15 is subjected to electrification control so that detected temperature of the edge thermistor T12-4E of the heating block HB14 maintains the control target temperature. The heating blocks HB11, HB12, HB16, and HB17 are heating blocks through which the recording material P does not pass and which are not adjacent to the heating block HB14 through which the edge of the recoding material P passes. Each of the heating blocks HB11, HB12, HB16, and HB17 is subjected to electrification control so that detected temperature of the main thermistor of each of the heating blocks HB11, HB12, HB16, and HB17 maintains the control target temperature. The control target temperature of the main thermistor T11-4C in a case of W≤150 mm is 240° C. Moreover, the control target temperature of each of the sub-thermistor T11-4E with which the heating block HB13 is controlled and the sub-thermistor T12-4E with which the heating block HB15 is controlled is also 240° C. The control target temperature of each of the main thermistors T11-1C, T11-2C, T12-6C, and T12-7C is 170° C.

Note that, it is possible to judge the width W of the recording material P by any of the following methods. That is, it is possible to judge the width W of the recording material P, for example, by a method based on a detection result by a sheet-width sensor provided in a feeding cassette, a method based on a detection result by a sensor, such as a flag, which is provided on a conveyance path of the recording material P, or a method based on width information of the recording material P, which is set by a user.

Subsequently, at S1003, the triac 1411 is subjected to PI control so that detected temperature of the thermistor determined at S1002 achieves the control target temperature, and power to be supplied to the heating block HB11 is controlled. At S1004, the triac 1412 is subjected to PI control so that detected temperature of the thermistor determined at S1002 achieves the control target temperature, and power to be supplied to the heating block HB12 is controlled. At S1005, the triac 1413 is subjected to PI control so that detected temperature of the thermistor determined at S1002 achieves the control target temperature, and power to be supplied to the heating block HB13 is controlled. At S1006, the triac 1414 is subjected to PI control so that detected temperature of the thermistor determined at S1002 achieves the control target temperature, and power to be supplied to the heating block HB14 is controlled. At S1007, the triac 1415 is subjected to PI control so that detected temperature of the thermistor determined at S1002 achieves the control target temperature, and power to be supplied to the heating block HB15 is controlled.

At S1008, the triac 1416 is subjected to PI control so that detected temperature of the thermistor determined at S1002 achieves the control target temperature, and power to be supplied to the heating block HB16 is controlled. At S1009, the triac 1417 is subjected to PI control so that detected temperature of the thermistor determined at S1002 achieves the control target temperature, and power to be supplied to the heating block HB17 is controlled. Note that, the control target temperature of each of the heating blocks HB11 to HB17 is set in accordance with size information of the recording material P.

At S1010, control of S1003 to S1009 is iterated until it is detected that print job is finished. When it is detected at S1010 that print job is finished, the relay 1430 and the relay 1440 are turned off at S1011, and the control sequence of image formation is finished at S1012.

Figure 7A:
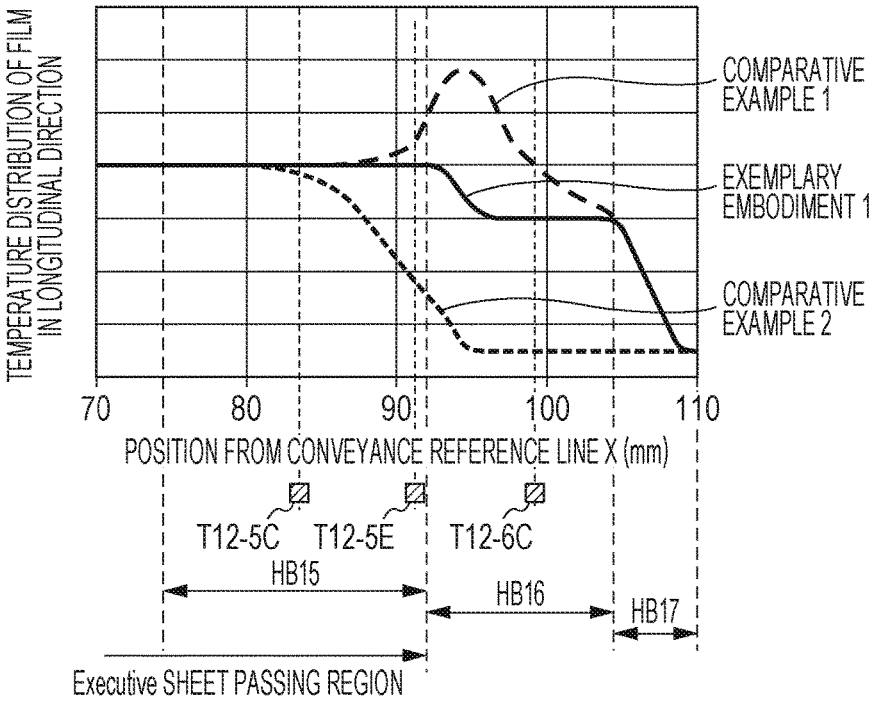
FIGS. 7A and 7B are views each illustrating temperature distribution of a film in a case where recording materials are subjected to continuous sheet passing.
Figure 7B:
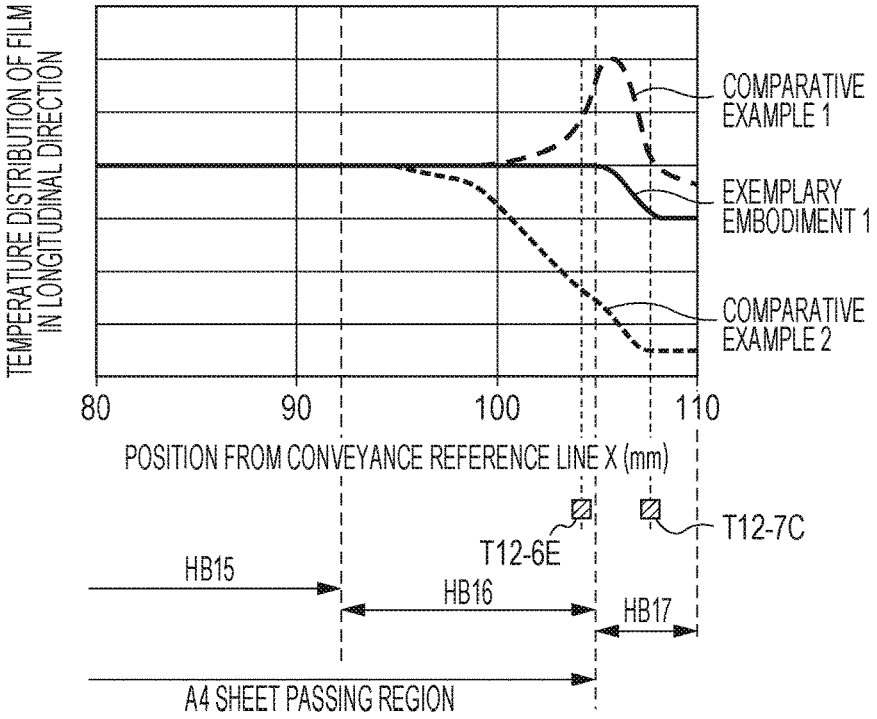

FIGS. 7A and 7B are views each illustrating temperature distribution of temperature of a surface of the film 202 in the longitudinal direction of the heater 1100 in a case where recording materials P are subjected to continuous sheet passing. FIG. 7A illustrates temperature distribution of a case where Executive paper (a width of which is 184 mm) is subjected to continuous sheet passing, and FIG. 7B illustrates temperature distribution of a case where A4 paper (a width of which is 210 mm) is subjected to continuous sheet passing.

As indicated in Table 1, for Executive paper, the heating blocks HB13 to HB15 that are heating blocks positioned in a region through which the recording material P passes are respectively subjected to electrification control on the basis of detected temperature of the main thermistors of the heating blocks HB13 to HB15. The control target temperature with which the detected temperature of each of the main thermistors is compared is 240° C. The heating block HB12 is subjected to electrification control on the basis of detected temperature of the edge thermistor T11-3E of the heating block HB13. The heating block HB16 is subjected to electrification control on the basis of detected temperature of the edge thermistor T12-5E of the heating block HB15. As is clear from the temperature distribution of the example embodiment 1 of FIG. 7A, the control target temperature with which the detected temperature of each of the edge thermistors is compared is also 240° C. The heating blocks HB11 and HB17 are respectively subjected to electrification control on the basis of detected temperature of the main thermistors of the heating blocks HB11 and HB17. The control target temperature with which the detected temperature of each of the main thermistors is compared is 170° C.

As above, in a case where the Executive paper is used, heat generation amounts of the heating blocks HB12 and HB16 that are adjacent to a sheet passing region are controlled in accordance with temperature of edge regions of the heating blocks HB13 and HB15, respectively. Thereby, it is possible to more excellently fix a toner image that is formed near an edge of the Executive paper, while suppressing excessive temperature rise of a non-sheet-passing region through which a recording material does not pass.

Whereas, examples in each of which a heating block adjacent to a sheet passing region is subjected to electrification control with a thermistor arranged in a region of the heating block are indicated as a comparative example 1 and a comparative example 2.

In the comparative example 1 and the comparative example 2 of FIG. 7A, the heating block HB16 adjacent to the sheet passing region of Executive paper is subjected to temperature control so that detected temperature of the thermistor T12-6*c* arranged in the heating block HB16 maintains the control target temperature. The control target temperature (control target temperature at a position of the thermistor T12-6C) of the heating block HB16 is set as 240° C. in the comparative example 1 and set as 170° C. in the comparative example 2. A temperature state of the fixing unit 200 in the longitudinal direction varies in accordance with a sheet passing condition of a recording material till then or a heating condition of the heater 1100, and a way in which heat is transferred from the heating block HB15 that is in the sheet passing region to an outside (heating blocks HB16 and HB17) changes. As indicated with the comparative example 1, even when the heating block HB16 is controlled so that 240° is maintained at the position of the thermistor T12-6C, in a state where a little heat is transferred from the heating block HB15 to the heating block HB16, temperature of the edge region of the heating block HB15 rises in some cases. In such a case, there is a concern that an image defect of an edge region of an image, such as hot offset, is caused. Accordingly, in order to reduce temperature of a non-sheet-passing region, it is necessary to delay a feeding operation of a recording material for next image formation.

Moreover, as indicated with the comparative example 2, even when the heating block HB16 is controlled so that 170° C. is maintained at the position of the thermistor T12-6C, in a state where much heat is transferred from the heating block HB15 to the heating block HB16, the temperature of the edge region of the heating block HB15 falls in some cases. In such a case, there is a concern that an image defect of an edge region of an image, such as fixing failure, is caused.

As above, in the comparative examples 1 and 2, it is difficult to stably maintain the temperature of the edge region of the heating block HB15. The similar applies to the heating block HB13 positioned in an opposite side in the longitudinal direction of the heater 1100 with respect to the conveyance reference line X.

On the other hand, in the example embodiment 1, the heating block HB16 is controlled so that 240° C. is maintained at a position of the thermistor T12-5E. Thereby, it is possible to maintain temperature near an edge of Executive paper as 240° C. which is suitable for fixation, and also possible to suppress excessive temperature rise of a region of the heating block HB16. In addition, as indicated in Table 1, for A4 paper, the heating blocks HB12 to HB16 that are heating blocks through which a recording material passes are subjected to electrification control on the basis of detected temperature of the main thermistors. The heating block HB11 is subjected to electrification control based on detected temperature of the edge thermistor T11-2E of the heating block HB12, and the heating block HB17 is subjected to electrification control based on detected temperature of the edge thermistor T12-6E of the heating block HB16. By such electrification control, a heat generation amount of the heating block HB17 adjacent to a sheet passing region is controlled. Thereby, it is possible to more excellently perform fixation of an edge region of the heating block HB16, while suppressing excessive temperature rise in a non-sheet-passing region. A similar effect is able to be obtained also in the heating block HB12 positioned in an opposite side in the longitudinal direction of the heater 1100 with respect to the conveyance reference line X.

Whereas, in the case of the comparative example 1, in a state where a little heat is transferred from the heating block HB16 to the heating block HB17, temperature of an edge region of the heating block HB16 rises in some cases as illustrated in FIG. 7B. Moreover, in the case of the comparative example 2, in a state where much heat is transferred from the heating block HB16 to the heating block HB17, temperature of the edge region of the heating block HB16 falls in some cases.

As described above, by arranging a thermistor in an inclination region of a heating block and using the thermistor to thereby control a heat generation amount of an adjacent heating block that is adjacent to the heating block, it is possible to control temperature distribution to be even in a longitudinal direction of the heating block. Thus, it is possible to suppress occurrence of an image defect in an edge of a recording material, and also possible to suppress temperature rise of a non-sheet-passing portion.

Although a form in which the thermistors are printed on the heater 1100 has been described in the present example embodiment, there is no limitation thereto. A form in which the thermistors are provided not in the heater 1100 but on a side of the holding member 201 to monitor temperature of the heater 1100 may be allowed.

(Example Embodiment 2)

An example embodiment 2 will be described below.

In the present example embodiment, description will be given for a heater 1200 and a control circuit 1500 which are obtained by modifying configurations of the heater 1100 and the control circuit 1400 that has been described in the example embodiment 1, respectively. Note that, configurations and processing that are different from those of the example embodiment 1 will be described in the present example embodiment, and description for configurations and processing that are similar to those of the example embodiment 1 will be omitted.

The fixing unit 200 of the present example embodiment performs heat generation control of each heating block in accordance with positional information of an image region that is a region in which an image is formed on the recording material P. Moreover, a main thermistor and an edge thermistor are arranged for each heating block also in the present example embodiment, but the edge thermistor is arranged in an inclination region of each of both sides of the heating block in the longitudinal direction of the heater 1200.

Figure 8A:
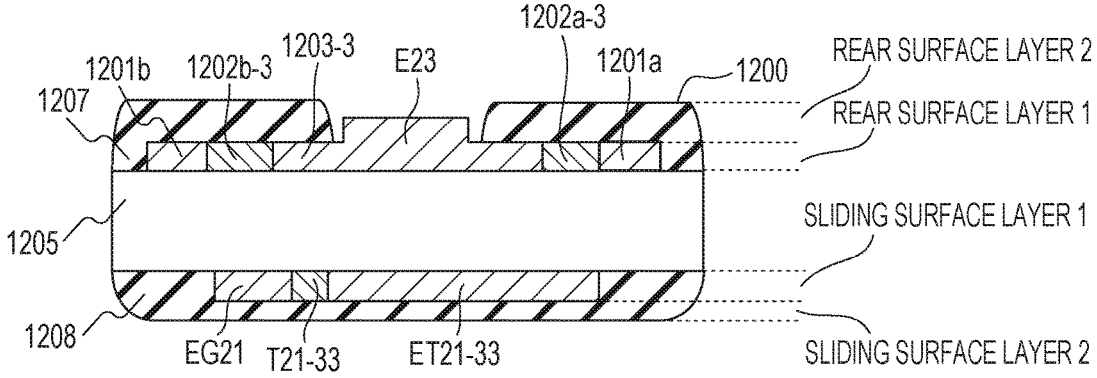
FIGS. 8A and 8B are views each illustrating a configuration of a heater of an example embodiment 2.
Figure 8B:
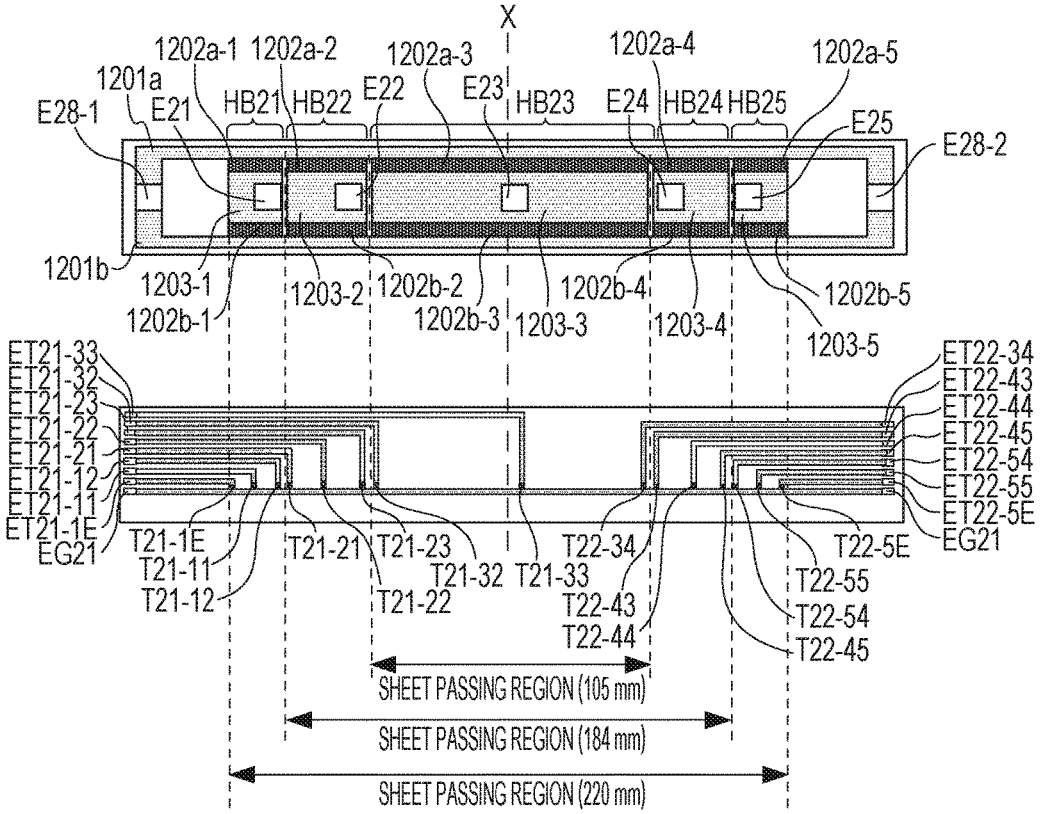

FIGS. 8A and 8B are views each illustrating a configuration of the heater 1200 of the present example embodiment. FIG. 8A illustrates a cross sectional view of the heater 1200 near the conveyance reference position X of the recording material P, which is illustrated in FIG. 8B. FIG. 8B illustrates a plan view of each layer of the heater 1200. The configuration of the heater 1200 will be described in detail by using FIGS. 8A and 8B. Similarly to the heater 1100 of the example embodiment 1, the heater 1200 is constituted by a substrate 1205, the sliding surface layer 1 that is provided on the substrate 1205, the sliding surface layer 2 that covers the sliding surface layer 1, the rear surface layer 1 that is provided on a surface of the substrate 1205, which is opposite to the sliding surface layer 1, and the rear surface layer 2 that covers the rear surface layer 1. In the present example embodiment, a plurality of heating blocks each of which is formed of a combination of a first conductive element 1201, a second conductive element 1203, and a heat generating resistor (heat generating element) 1202 are provided on the rear surface layer 1 along a longitudinal direction thereof. The heater 1200 of the present example embodiment has five heating blocks HB21 to HB25 in total. Independent control of the heating blocks HB21 to HB25 will be described below.

A plurality of first conductive elements 1201 are provided on the substrate 1205 along the longitudinal direction, and a plurality of second conductive elements 1203 are provided on the substrate 1205 along the longitudinal direction at positions which are different in a transverse direction from those of the first conductive elements 1201. Each of a heat generating resistors 1202 is provided between each of the first conductive elements 1201 and each of the second conductive elements 1203, and generates heat by power supplied via the first conductive element 1201 and the second conductive element 1203.

The heat generating resistors 1202 of the respective heating blocks are divided into heat generating resistors 1202*a* and heat generating resistors 1202*b* that are formed at positions which are mutually symmetrical about a center of the substrate 1205 in a transverse direction of the heater 1200. Moreover, the first conductive elements 1201 are divided into a conductive element 1201*a* which is connected to the heat generating resistors 1202*a* and a conductive element 1201*b* which is connected to the heat generating resistors 1202*b*.

Since the heater 1200 has the five heating blocks HB21 to HB25, the heat generating resistors 1202*a* are divided into five heating generating resistors 1202*a*-1 to 1202*a*-5. Similarly, the heat generating resistors 1202*b* are divided into five heat generating resistors 1202*b*-1 to 1202*b*-5. Furthermore, the second conductive elements 1203 are also divided into five second conductive elements 1203-1 to 1203-5. Note that, the heat generating resistors 1202*a*-1 to 1202*a*-5 are arranged in the substrate 1205 on an upstream side of the conveyance direction of the recording material P, and the heat generating resistors 1202*b*-1 to 1202*b*-5 are arranged in the substrate 1205 on a downstream side of the conveyance direction of the recording material P.

On the rear surface layer 2 of the heater 1200, a surface protecting layer 1207 that covers the heat generating resistors 1202, the first conductive elements 1201, and the second conductive elements 1203 and is insulating (in the present example embodiment, made of glass) is provided. However, the surface protecting layer 1207 covers none of electrodes E21 to E25 with which electric contacts for power supply are in contact. The electrodes E21 to E25 are electrodes for supplying power to the heating blocks HB21 to HB25 via the second conductive elements 1203-1 to 1203-5, respectively. Electrodes E28-1 and E28-2 are electrodes for supplying power to the heating blocks HB21 to HB25 via the first conductive elements 1201*a* and 1201*b*.

By the way, since a resistance value of each of the conductive elements is not zero, there is a concern that heat generation distribution in the longitudinal direction of the heater 1200 is affected. Then, the electrodes E28-1 and E28-2 are separately provided in both ends of the heater 1200 in the longitudinal direction so that the heat generation distribution does not become uneven even when being affected by electric resistance of the first conductive elements 1201*a* and 1201*b* and the second conductive elements 1203-1 to 1203-5. Each of the electric contacts is connected to the control circuit 1500 of the heater 1200, which will be described below, via a conductive member, such as a cable or a thin metal plate, which is provided in the space between the stay 204 and the holding member 201. Note that, as illustrated in FIG. 8B, the electrodes E21 to E25 are provided in a region in which the heat generating resistors 1202 are provided in the longitudinal direction of the substrate 1205.

Similarly to the example embodiment 1, as described below, the heater 1200 of the present example embodiment is also able to form various types of heat generation distribution by independently controlling the plurality of heating blocks HB21 to HB25. It is thereby possible to set heat generation distribution according to a size of a recording material, for example. Further, the heat generating resistors 1202 are also formed of a material having a PTC. By using the material having the PTC, it is possible to suppress temperature rise of a non-sheet-passing portion, even in a case where an edge of a recording material and a boundary between the heating blocks are not coincident with each other.

On the sliding surface layer 1 on a side of a sliding surface of the heater 1200, a plurality of thermistors T21-1E, T21-11 to T21-33, T22-34 to T22-55, and T22-5E for detecting temperature of each of the heating blocks HB21 to HB25 are formed. A material of the thermistors is only required to be a material whose TCR is positively or negatively great. Also in the present example embodiment, each of the thermistors is formed by thinly printing a material having an NTC on the substrate 1205.

Moreover, also in the present example embodiment, two or more thermistors deal with each of all the heating blocks HB21 to HB25. Therefore, it is configured so that, even when one of the plurality of thermistors that deal with one heating block malfunctions, it is possible to detect temperature of the heating block by using another thermistor and thereby possible to detect temperature of all the heating blocks HB21 to HB25.

Hereinafter, arrangement of the thermistors with respect to each of the heating blocks HB21 to HB25 will be described.

In the present example embodiment, two or more thermistors are arranged for one heating block as illustrated in FIG. 8B. For example, it is configured so that three thermistors T21-32, T21-33, and T22-34 are provided for the heating block HB23 and able to respectively detect temperature by conductive patterns for resistance value detection ET21-32, ET21-33, and ET22-34 and a common conductive pattern EG21.

The thermistor T21-33 is a main thermistor by which temperature of a center region of the heating block HB23 is detected, and arranged in a substantially center part of the heating block HB23 in the longitudinal direction of the heater 1200. Moreover, the thermistor T21-32 is an edge thermistor by which temperature of an edge region of the heating block HB23 is detected, and arranged in an edge region of the heating block HB23 and on a side adjacent to the heating block HB22. The thermistor T22-34 is an edge thermistor by which temperature of an edge region of the heating block HB23 is detected, and arranged in an edge region of the heating block HB23 and on a side adjacent to the heating block HB24.

In this manner, with respect to each of the heating blocks HB21 to HB25, a main thermistor for detecting temperature of a center region is arranged in a substantially center part of the heating block, and an edge thermistor for detecting temperature of an edge region is arranged in each of edge regions of the heating block.

On a surface (sliding surface layer 2) of the substrate 1205 on a side of the fixing nip portion N, in order to secure slidability of the film 202, a surface protecting layer 1208 that is insulating (in the present example embodiment, made of glass) is formed by coating. The surface protecting layer 1208 covers the main thermistors, conductive patterns, and a common conductive pattern. However, in order to secure connection with electric contacts, a part of the conductive patterns and a part of the common conductive pattern are exposed.

Figure 9A:
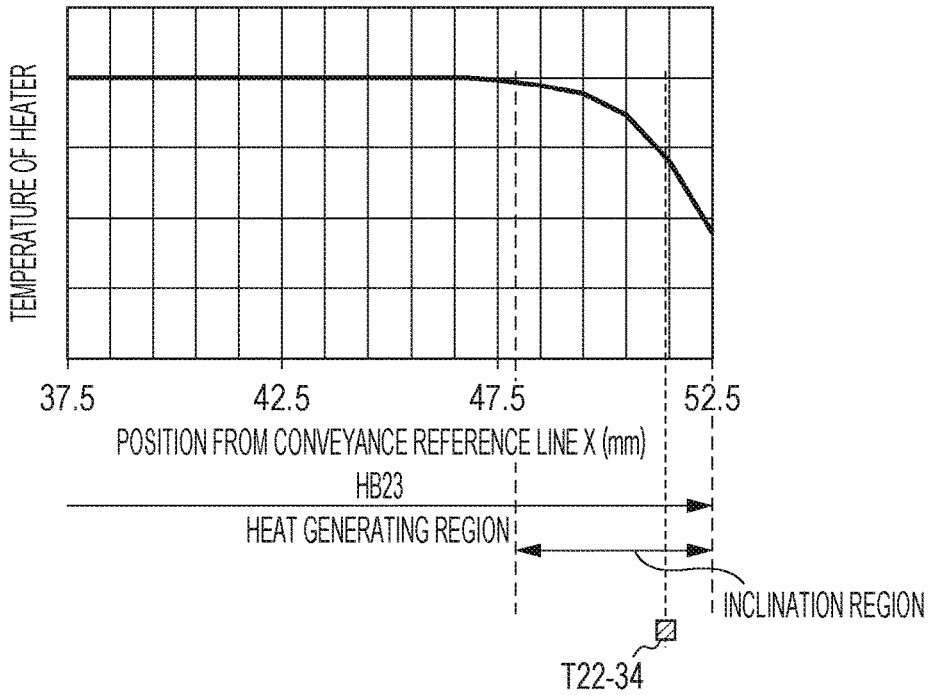
FIGS. 9A and 9B are views each illustrating temperature distribution in a longitudinal direction of the heater and arrangement of a thermistor of the example embodiment 2.
Figure 9B:
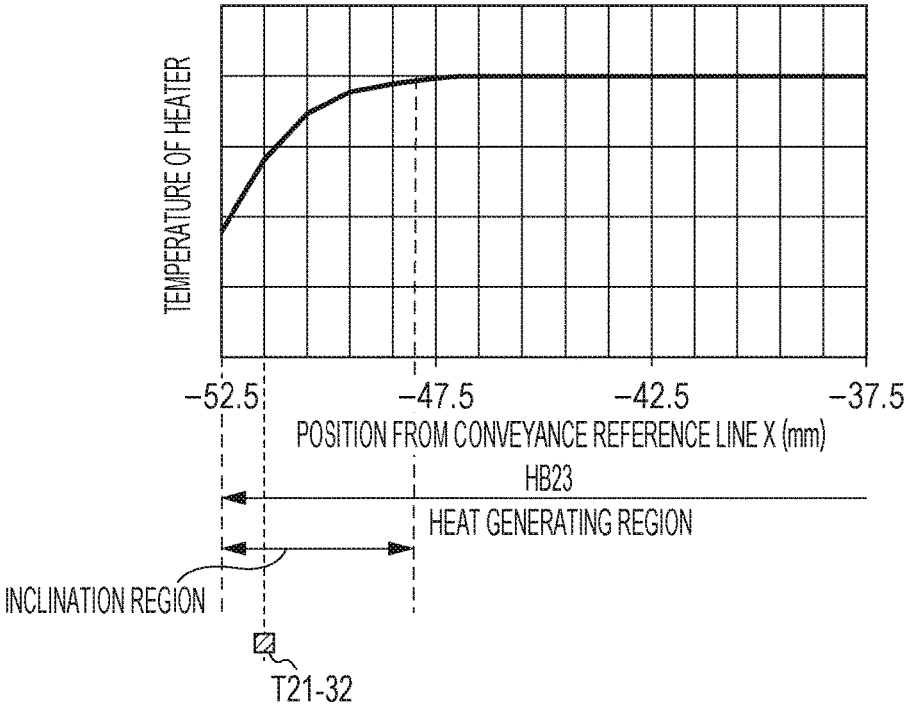

FIGS. 9A and 9B are views each illustrating temperature distribution of the heater 1200 in the longitudinal direction of the heater 1200 and detailed arrangement of the thermistor.

Here, the representative heating block HB23 will be described. Each of FIGS. 9A and 9B illustrates temperature distribution of a region on a sliding surface layer side of the heater 1200 when the heating block HB23 is caused to generate heat alone from normal temperature (25° C.). A heat generating region of the heating block HB23 is a region whose distance from the conveyance reference line X to each of both sides in the longitudinal direction is up to 52.5 mm. In FIG. 9B, a position on a side of the heating block HB22 from the conveyance reference line X is indicated with a minus sign. In a case where the heating block HB23 is caused to generate heat alone, heat is transferred to regions of the heating blocks HB22 and HB24 which are in proximity thereto and are not caused to generate heat, so that temperature of each of inclination regions that are edge regions of the heating block HB23 is lowered. In the present example embodiment, the edge thermistors T21-32 and T22-34 are arranged in the inclination regions. Moreover, the main thermistor T21-33 is arranged in the center region of the heating block HB23 in the longitudinal direction of the heater 1200.

As above, also in the present example embodiment, the main thermistor and the edge thermistors are arranged for each of the heating blocks HB21 to HB25. Moreover, in the present example embodiment, the edge thermistors are respectively arranged in inclination regions on both end sides of the heating block in the longitudinal direction of the heater 1200 and arranged at positions each of which is, in the inclination region, in an inner side by 1 mm from an edge of the heating block. Although description has been given above for the heating block HB23, one main thermistor and two edge thermistors are arranged also for each of the other heating blocks HB21, HB22, HB24, and HB25 similarly to the heating block HB23.

Figure 10:
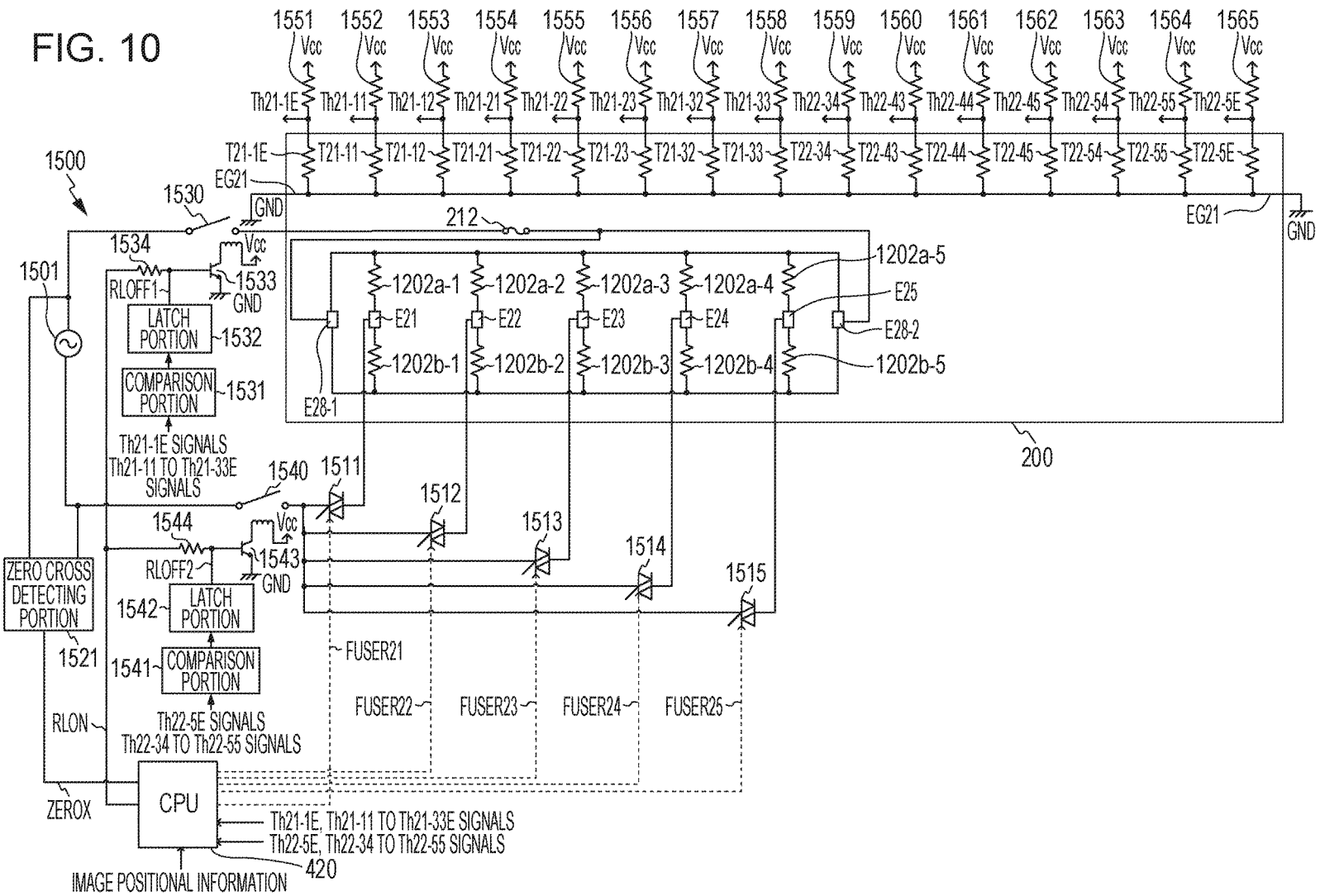
FIG. 10 is a circuit diagram of a control circuit serving as a control unit of the heater of the example embodiment 2.

FIG. 10 is a circuit diagram of the control circuit 1500 that is a control unit of the heater 1200.

An alternating current power supply 1501 is connected to a laser printer 100 and used for a commercial purpose. Power control for the heater 1200 is performed by electrifying/intercepting, by triacs 1511 to 1515, power supply to the heater 1200. The triacs 1511 to 1515 operate in accordance with FUSER21 to FUSER25 signals from the CPU 420, respectively. The control circuit 1500 of the heater 1200 has a circuit configuration that is able to independently perform control of the five heating blocks HB21 to HB25 by the five triacs 1511 to 1515. Note that, a driving circuit of each of the triacs 1511 to 1515 is omitted in FIG. 10.

A zero cross detecting portion 1521 is a circuit that detects zero cross of the alternating current power supply 1501, and outputs a ZEROX signal to the CPU 420. The ZEROX signal is used, for example, as a reference signal with which phase control of the triacs 1511 to 1515 is performed.

Next, a temperature detection method of the heater 1200 will be described.

Signals (Th21-1E, Th21-11 to Th21-33, Th22-34 to Th22-55, and Th22-5E) that are obtained by dividing the voltage Vcc by resistance values of the thermistors and resistance values of resistances 1551 to 1565 are input to the CPU 420. Here, the thermistors are indicated by reference signs of T21-1E, T21-11 to T21-33, T22-34 to T22-55, and T22-5E in FIG. 10. For example, the signal Th21-33 is a signal obtained by dividing the voltage Vcc by the resistance value of the thermistor T21-33 and the resistance value of the resistance 1558. Since the thermistor T21-33 has the resistance value according to temperature, when temperature of the heating block HB23 changes, a level of the signal Th21-33 to be input to the CPU 420 also changes. The CPU 420 converts each of the input signals into temperature according to a level thereof.

On the basis of setting temperature (control target temperature) of each of the heating blocks and detected temperature of each of the thermistors, the CPU 420 calculates, for example, by PI control, power to be supplied to the heater 1200. Furthermore, the CPU 420 converts the calculated supplied power into control timing such as a phase angle (phase control) or a wave number (wave number control) each of which corresponds thereto, and controls the triacs 1511 to 1515 at the control timing. Since processing of the signals corresponding to the other thermistors is similar, description thereof will be omitted.

Next, power control for the heater 1200 (temperature control of the heater 1200) will be described.

During fixing processing, each of the heating blocks HB21 to HB25 is controlled so that detected temperature of each of the thermistors maintains the setting temperature (control target temperature). Specifically, power to be supplied to the heating block HB23 is controlled by controlling drive of the triac 1513 so that the detected temperature of the thermistor T21-33 maintains the setting temperature.

In this manner, each of the thermistors is used when control for keeping temperature of each of the heating blocks HB21 to HB25 constant is executed. Relays 1530 and 1540 are mounted as a unit configured to intercept power to the heater 1200 in a case where temperature of the heater 1200 excessively rises due to malfunction of the device or the like.

Next, a circuit operation of the relays 1530 and 1540 will be described.

When an RLON signal output from the CPU 420 is brought into a High state, a transistor 1533 is brought into an ON state, a secondary-side coil of the relay 1530 is electrified from a direct current power supply (voltage Vcc), and a primary-side contact of the relay 1530 is brought into the ON state. When the RLON signal is brought into a Low state, the transistor 1533 is brought into an OFF state, a current flowing to the secondary-side coil of the relay 1530 from the power supply (voltage Vcc) is intercepted, and the primary-side contact of the relay 1530 is brought into the OFF state. Similarly, when the RLON signal is brought into the High state, a transistor 1543 is brought into the ON state, a secondary-side coil of the relay 1540 is electrified from the power supply (voltage Vcc), and a primary-side contact of the relay 1540 is brought into the ON state. When the RLON signal is brought into the Low state, the transistor 1543 is brought into the OFF state, a current flowing to the secondary-side coil of the relay 1540 from the power supply (voltage Vcc) is intercepted, and the primary-side contact of the relay 1540 is brought into the OFF state.

Next, an operation of a protection circuit that uses the relays 1530 and 1540 (hard circuit that does not use the CPU 420) will be described.

When a level of any of the signals Th21-1E and Th21-11 to Th21-33 exceeds a predetermined value that is set in an inside of a comparison portion 1531, the comparison portion 1531 causes a latch portion 1532 to operate. Thereby, the latch portion 1532 latches an RLOFF1 signal in the Low state. In a case where the RLOFF1 signal is brought into the Low state, even when the CPU 420 brings the RLON signal into the High state, the transistor 1533 is kept in the OFF state, so that the relay 1530 is able to keep the OFF state (safe state). Note that, during a non-latched state, the latch portion 1532 keeps the RLOFF1 signal as an output in an open state.

Similarly, when a level of any of the signals Th22-5E and Th22-34 to Th22-55 exceeds a predetermined value that is set in an inside of a comparison portion 1541, the comparison portion 1541 causes a latch portion 1542 to operate. Thereby, the latch portion 1542 latches an RLOFF2 signal in the Low state. In a case where the RLOFF2 signal is brought into the Low state, even when the CPU 420 brings the RLON signal into the High state, the transistor 1543 is kept in the OFF state, so that the relay 1540 is able to keep the OFF state (safe state). During the non-latched state, the latch portion 1542 keeps the RLOFF2 signal as an output in the open state. In this case, both the predetermined value set in the inside of the comparison portion 1531 and the predetermined value set in the inside of the comparison portion 1541 in the present example embodiment are set as values corresponding to 300° C.

Figure 11:
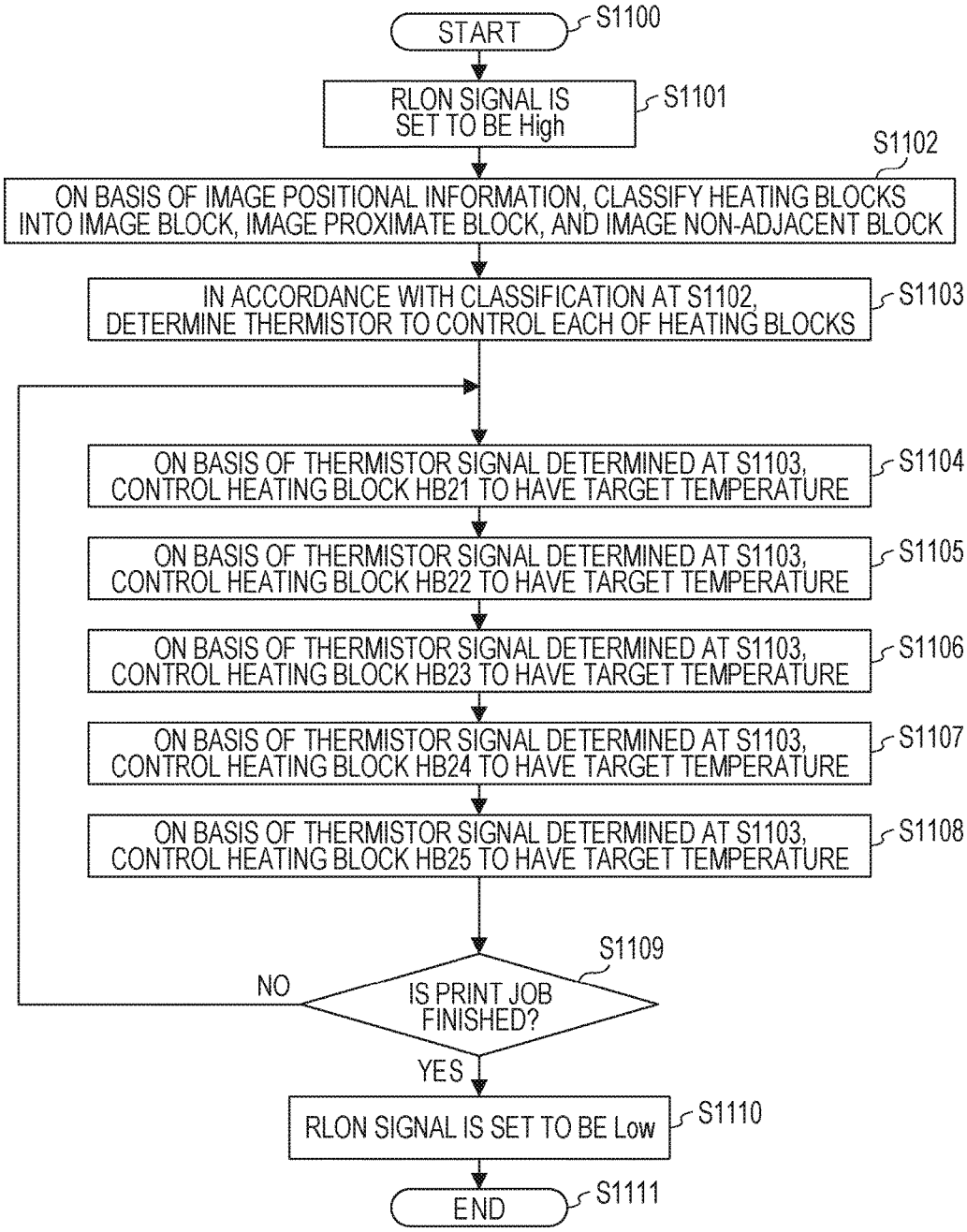
FIG. 11 is a flowchart for explaining control processing of the control circuit by a CPU of the example embodiment 2.

FIG. 11 is a flowchart for explaining a control sequence of the control circuit 1500, which is performed by the CPU 420.

When a print request is generated at S1100, the relays 1530 and 1540 are brought into the ON state at S1101. At S1102, positional information of an image region on the recording material P is acquired. Then, in accordance with whether or not an image on the recording material P passes through a region of each of the heating blocks HB21 to HB25 when being nipped by the fixing nip portion N, each of the heating blocks HB21 to HB25 is classified as an image block (first heating block), an image proximate block (second heating block), or an image non-proximate block (third heating block). Here, a heating block through which an image (image region) passes is an image block. A heating block through an inside of which an image does not pass and which is proximate to a heating block that is an image block is set as an image proximate block. A heating block through an inside of which an image does not pass and which is proximate to a heating block through which an image does not pass is classified as an image non-proximate block.

Figure 12A:
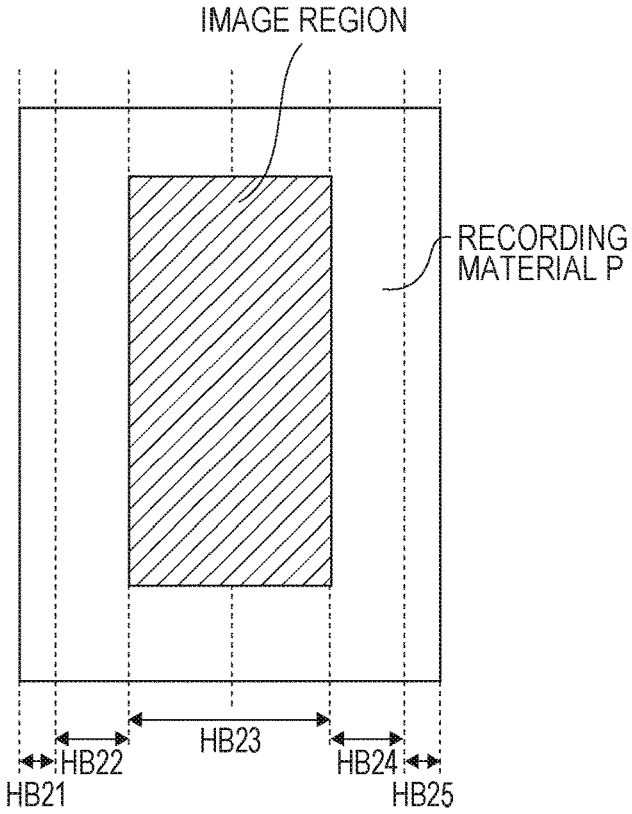
FIGS. 12A and 12B are views each illustrating a position of an image region on a recording material and classification of heating blocks of the example embodiment 2.
Figure 12B:
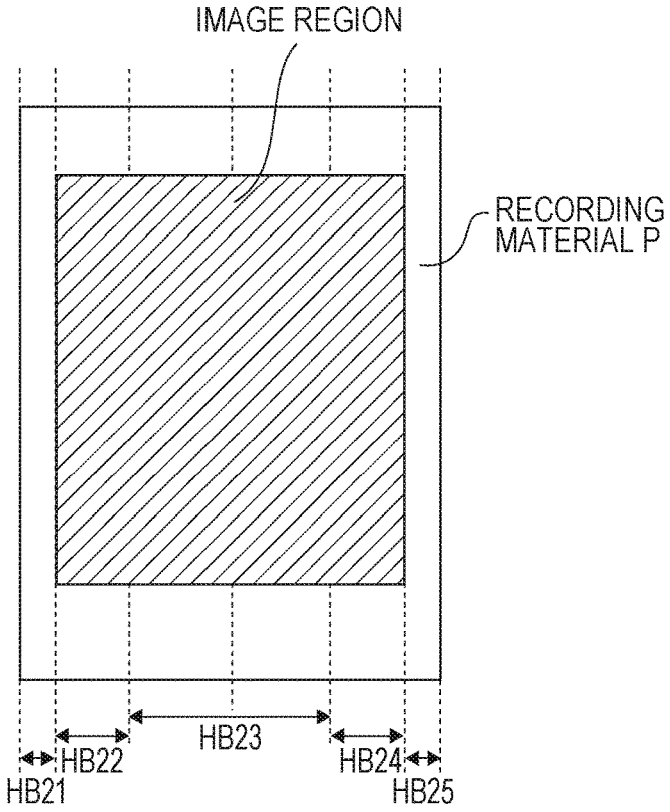

FIGS. 12A and 12B are views each illustrating an example of a position of an image region on the recording material P and classification of the heating blocks HB21 to HB25.

In FIG. 12A, an image region indicated with slanting lines is positioned in the heating block HB23, and is therefore classified as the image block. The heating blocks HB22 and HB24 are heating blocks in which an image does not exist and which are proximate to the heating block HB23 in which an image exists, and are thus classified as the image proximate blocks. The heating blocks HB21 and HB25 are heating blocks in which an image does not exist and which are respectively proximate to the heating blocks HB22 and HB24 in each of which an image does not exist, and thus classified as image non-proximate blocks. In FIG. 12B, the heating blocks HB22, HB23, and HB24 are classified as the image blocks and the heating blocks HB21 and HB25 are classified as the image proximate block.

Subsequently, at S1103, in accordance with the classification of S1102, the thermistor that is to be used at a time of controlling each of the heating blocks HB21 to HB25 is determined.

In the image block, electrification control is performed so that detected temperature of the main thermistor of the heating block of the image block maintains the control target temperature. In the image proximate block, electrification control is performed so that detected temperature of the edge thermistor (on a side of the image proximate block) of the proximate heating block in which an image exists maintains the control target temperature. In the image non-proximate block, electrification control is performed so that detected temperature of the main thermistor of the heating block of the image non-proximate block maintains the control target temperature.

Note that, since no image exists in the image non-proximate block, the control target temperature is set to be low compared with that of the image block. In the image proximate block, heat generation control is performed to an extent that temperature of the edge thermistor of the image block is not lowered, and power consumption of the image proximate block is reduced.

An example of a correspondence relation between a position of an image region and a thermistor to be used for control is indicated in Table 2.

TABLE 2

| Image region | HB21 | HB22 | HB23 | HB24 | HB25 |
|---|---|---|---|---|---|
| HB21, HB22, HB23, HB24, HB25 | Image T21-11 | Image T21-22 | Image T21-33 | Image T22-44 | Image T22-55 |
| HB21, HB22, HB23, HB24 | Image T21-11 | Image T21-22 | Image T21-33 | Image T22-44 | Image proximate T22-45 |
| HB21, HB22, HHB23 | Image T21-11 | Image T21-22 | Image T21-33 | Image proximate T22-34 | Image non-proximate T22-55 |
| HB22, HB23, HB24 | Image proximate T21-21 | Image T21-22 | Image T21-33 | Image T22-44 | Image proximate T22-45 |
| HB22, HB23 | Image proximate T21-21 | Image T21-22 | Image T21-33 | Image proximate T22-34 | Image non-proximate T22-55 |
| HB23 | Image non-proximate T21-11 | Image proximate T21-32 | Image T21-33 | Image proximate T22-34 | Image non-proximate T22-55 |

The thermistor that is to be used for maintaining setting temperature (control target temperature) is determined for each of the heating blocks HB21 to HB25.

For example, in a case where an image illustrated in FIG. 12A is subjected to fixing processing, the heating block HB23 is the image block, and electrification control thereof is performed by using the main thermistor T21-33 of the heating block HB23. The heating block HB22 is the image proximate block, and electrification control thereof is performed by using the edge thermistor T21-32 of the heating block HB23 in which the image exists. Similarly, the heating block HB24 is also the image proximate block, and electrification control thereof is performed by using the edge thermistor T22-34 of the heating block HB23 in which the image exists. The heating blocks HB21 and HB25 are the image non-proximate blocks, and electrification control thereof is performed by using the main thermistors T21-11 and T22-55 of the heating blocks HB21 and HB25, respectively. Note that, the image positional information is able to be obtained by classifying image data into data of each of the heating blocks HB21 to HB25 and judging presence or absence of an image by an image region judgment portion which is not illustrated.

Then, at S1104, the triac 1511 is subjected to PI control so that detected temperature of the thermistor determined at S1103 achieves the control target temperature, and power to be supplied to the heating block HB21 is controlled. At S1105, the triac 1512 is subjected to PI control so that detected temperature of the thermistor determined at S1103 achieves the control target temperature, and power to be supplied to the heating block HB22 is controlled. At S1106, the triac 1513 is subjected to PI control so that detected temperature of the thermistor determined at S1103 achieves the control target temperature, and power to be supplied to the heating block HB23 is controlled. At S1107, the triac 1514 is subjected to PI control so that detected temperature of the thermistor determined at S1103 achieves the control target temperature, and power to be supplied to the heating block HB24 is controlled. At S1108, the triac 1515 is subjected to PI control so that detected temperature of the thermistor determined at S1103 achieves the control target temperature, and power to be supplied to the heating block HB25 is controlled. Note that, the control target temperature of each of the heating blocks HB21 to HB25 is set in accordance with recording material information.

At S1109, control of S1104 to S1108 is iterated until it is detected that print job is finished. When it is detected at S1109 that print job is finished, the relays 1530 and 1540 are turned off at S1110, and the control sequence of image formation is finished at S1111.

Figure 13A:
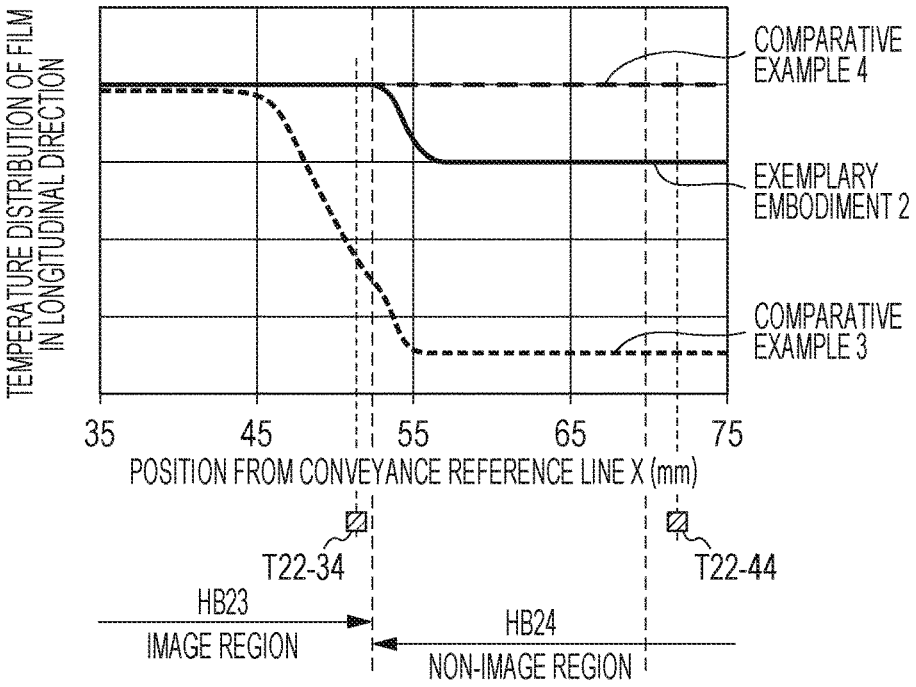
FIGS. 13A and 13B are views each illustrating temperature distribution of a film in the example embodiment 2.
Figure 13B:
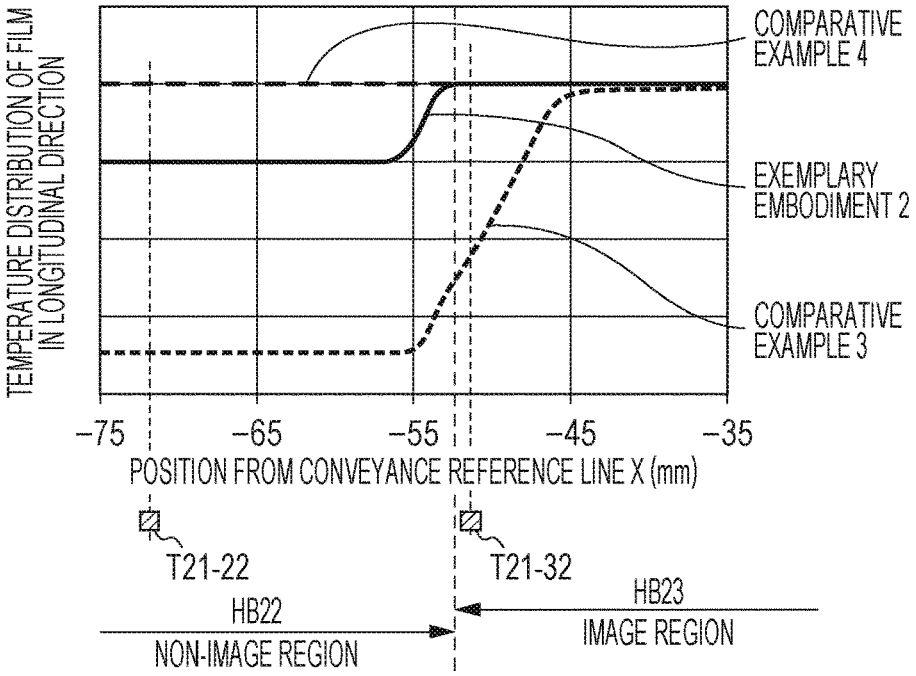

FIGS. 13A and 13B are views each illustrating temperature distribution of the film 202 in the longitudinal direction of the heater 1200 in a case where, in the present example embodiment, an image illustrated in FIG. 12A is formed on a recording material P having an LTR size. FIG. 13A illustrates detailed temperature distribution of a heating block HB24 side of the heating block HB23, and FIG. 13B illustrates detailed temperature distribution of a heating block HB22 side of the heating block HB23.

As illustrated in Table 2, the heating block HB23 is an image block, and electrification control is performed by using the main thermistor T21-33 of the heating block HB23. Moreover, since the heating block HB22 is an image proximate block, control is performed by using the edge thermistor T21-32 of the heating block HB23 in which an image exists. Similarly, since the heating block HB24 is also an image proximate block, control is performed by using the edge thermistor T22-34 of the heating block HB23 in which an image exists.

By controlling heat generation amounts of the heating block HB23 which is the image block and the heating blocks HB22 and HB24 which are adjacent to the heating block HB23 by the electrification control as above, it is possible to maintain temperature of edge regions of the heating block HB23 to be temperature that allows fixation, while suppressing excessive temperature rise of the heating blocks HB22 and HB24. Moreover, by controlling heat generation of the heating blocks HB22 and HB24 which are the image proximate blocks to such an extent that temperature of the edges of the image block is not lowered and setting control target temperature of an image non-proximate block to be low, it is possible to suppress power consumption.

In comparative examples 3 and 4, an image proximate block is controlled on the basis of detected temperature of the main thermistor in the image proximate block. The comparative example 3 indicates a case where control target temperature of the image proximate block is set to be the same as that of an image block, and the comparative example 4 indicates a case where the control target temperature of the image proximate block is set to be lower than that of an image block. Each of the comparative examples 3 and 4 indicates temperature distribution of a case where the heating block HB24 that is adjacent to the heating block HB23 which is the image block is controlled by using the thermistor T22-44 arranged in the heating block HB24. A temperature state of the fixing unit 200 in the longitudinal direction varies in accordance with a sheet passing condition or an image region of a recording material till then or a heating condition of the heater 1200, and a way in which heat is transferred from the heating block HB23 that is the image block to an outside (heating block HB24 side) changes.

As indicated by the comparative example 3, in a state where much heat is transferred from the heating block HB23 to the heating block HB24 or HB22, when the control target temperature of the heating block HB24 or HB22 in each of which no image exists is too low, temperature of the edge region of the heating block HB23 falls in some cases. Thus, there are some cases where fixing failure is caused to toner in an edge region of an image.

Moreover, as indicated by the comparative example 4, in a case where the control target temperature of the heating block HB24 or HB22 in each of which no image exists is set to be the same control target temperature as that of the heating block HB23 which is the image block, it is possible to keep the temperature of the edge region of the heating block HB23 to be temperature which is suitable for fixation. However, in this case, a region in which no image exists is to be heated more than necessary, so that power consumption is increased compared with the example embodiment 2. As above, in the comparative examples, it is difficult to maintain the temperature of the edge region of the heating block HB23 to be temperature which is suitable for fixation and optimize power consumption.

As described above, according to the present example embodiment, it is possible to obtain an effect similar to that of the example embodiment 1 and, furthermore, temperature control of heating blocks is able to be performed in accordance with image information, thus making it possible to suppress and optimize power consumption of an image heating device.

(Example Embodiment 3)

An example embodiment 3 will be described below.

In the present example embodiment, description will be given for a heater 1300 which is obtained by modifying the configuration of the heater 1200 that has been described in the example embodiment 2. Note that, configurations and processing that are different from those of the example embodiments 1 and 2 will be described in the present example embodiment, and description for configurations and processing that are similar to those of the example embodiments 1 and 2 will be omitted.

Also in the present example embodiment, a main thermistor and an edge thermistor are arranged for each of heating blocks. Further, the edge thermistor of the present example embodiment is arranged at a position closest to an adjacent heating block in an inclination region.

Figure 14:
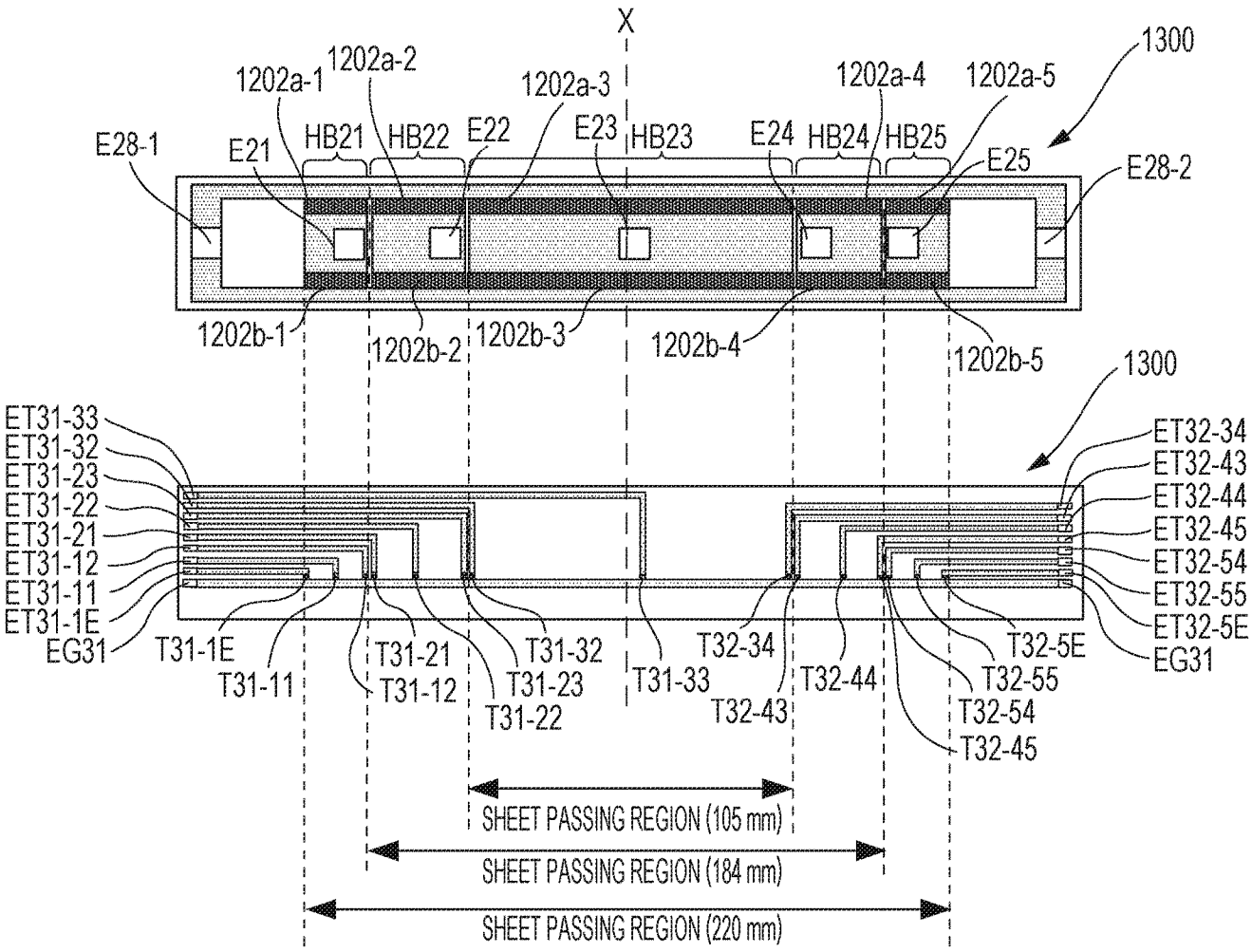
FIG. 14 is a view illustrating a configuration of a heater of an example embodiment 3.

FIG. 14 is a view illustrating a configuration of the heater 1300 of the present example embodiment. The configuration of the heater 1300 will be described in detail by using FIG. 14.

Similarly to the heater 1200 of the example embodiment 2, the heater 1300 of the present example embodiment has five heating blocks HB21 to HB25 in total. Configurations of the heating blocks HB21 to HB25 are the same as what has been described in the example embodiment 2.

On the sliding surface layer 1 on a side of a sliding surface of the heater 1300, a plurality of thermistors T31-1E, T31-11 to T31-33, T32-34 to T32-55, and T32-5E for detecting temperature of each of the heating blocks HB21 to HB25 are formed. Also in the present example embodiment, two or more thermistors deal with each of all the heating blocks HB21 to HB25. Therefore, it is configured so that, even when one of the plurality of thermistors that deal with one heating block malfunctions, it is possible to detect temperature of the heating block by using another thermistor and thereby possible to detect temperature of all the heating blocks HB21 to HB25.

Hereinafter, arrangement of the thermistors with respect to each of the heating blocks HB21 to HB25 will be described.

In the present example embodiment, two or more thermistors are arranged for one heating block as illustrated in FIG. 14. For example, it is configured so that three thermistors T31-32, T31-33, and T32-34 are provided for the heating block HB23 and able to respectively detect temperature by conductive patterns for resistance value detection ET31-32, ET31-33, and ET32-34 and a common conductive pattern EG31.

The thermistor T31-33 is a main thermistor by which temperature of the center region is detected, and arranged in the substantially center part of the heating block HB23 in a region in a longitudinal direction of the heating block HB23. Moreover, the thermistor T31-32 is an edge thermistor by which temperature of an edge region is detected, and arranged in an edge region which is on a side adjacent to the heating block HB22. The thermistor T32-34 is an edge thermistor by which temperature of an edge region is detected, and arranged in an edge region which is on a side adjacent to the heating block HB24.

In this manner, with respect to each of the heating blocks HB21 to HB25, a main thermistor for detecting temperature of a center region is arranged in a substantially center part of the heating blocks HB21 to HB25 in the longitudinal direction of the heater 1300, and an edge thermistor for detecting temperature of an edge region is arranged in each of edge regions of the heating block in the longitudinal direction of the heater 1300.

Figure 15A:
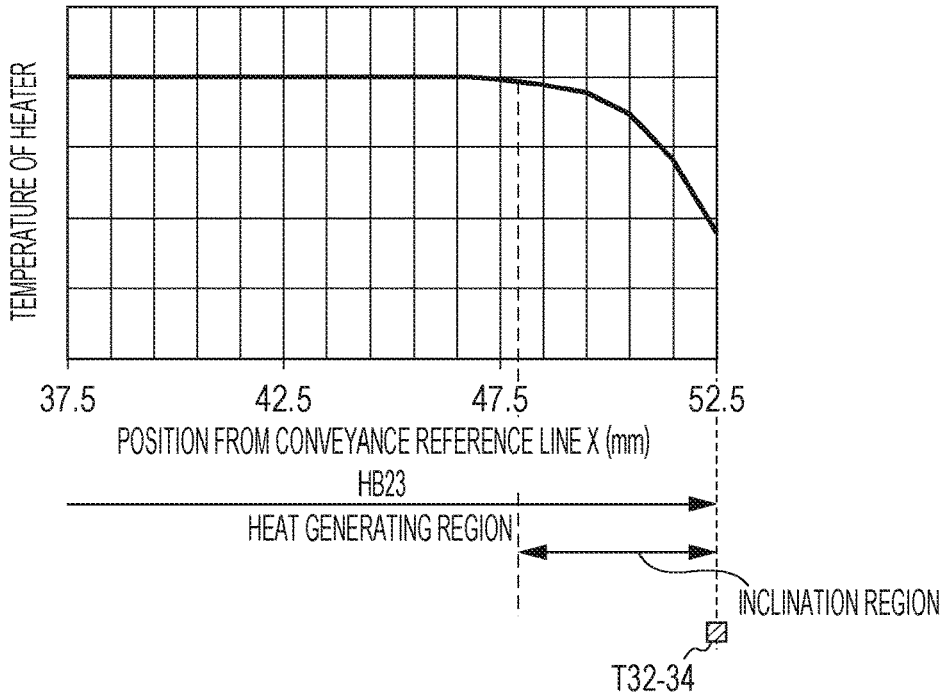
FIGS. 15A and 15B are views each illustrating temperature distribution in a longitudinal direction of the heater and arrangement of a thermistor of the example embodiment 3.
Figure 15B:
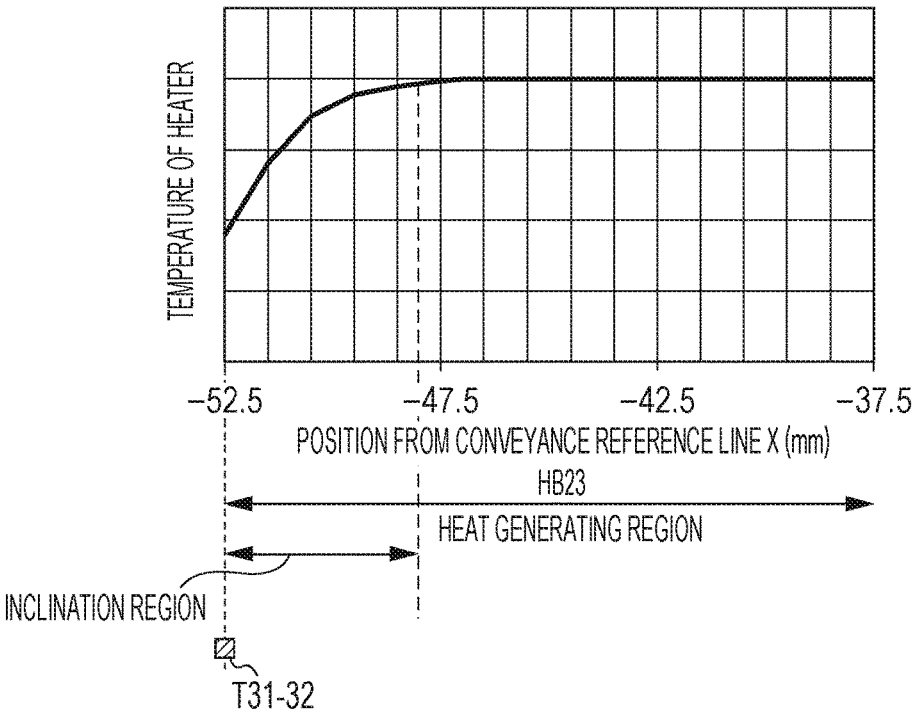

FIGS. 15A and 15B are views each illustrating temperature distribution of the heater 1300 in the longitudinal direction of the heater 1300 and detailed arrangement of the thermistor.

Here, the representative heating block HB23 will be described. FIGS. 15A and 15B illustrate temperature distribution of a region on a sliding surface layer side of the heater 1300 when the heating block HB23 is caused to generate heat alone from normal temperature (25° C.), and correspond to FIGS. 9A and 9B of the example embodiment 2, respectively.

In a case where the heating block HB23 is caused to generate heat alone, heat is transferred to regions of the heating blocks HB22 and HB24 which are in proximity thereto and are not caused to generate heat, so that temperature of each of inclination regions that are edge regions of the heating block HB23 is lowered. In the present example embodiment, the edge thermistors T31-32 and T32-34 are arranged in the inclination regions. To describe arrangement positions further correctly, each of the edge thermistors T31-32 and T32-34 is arranged at a position which is distant by 52.5 mm from the conveyance reference line X toward each of both sides in the longitudinal direction of the heater 1300 and which is an end most part of the heating block HB23. Moreover, the main thermistor T31-33 is arranged in the center region of the heating block HB23 in the longitudinal direction of the heater 1300.

As above, also in the present example embodiment, the main thermistor and the edge thermistors are arranged for each of the heating blocks HB21 to HB25. Moreover, in the present example embodiment, each of the edge thermistors is arranged at the position in the end most part in the inclination region of the heating block. Although description has been given above for the heating block HB23, the main thermistor and the edge thermistors are arranged also for each of the other heating blocks HB21, HB22, HB24, and HB25 similarly to the heating block HB23. Moreover, since the control sequence of the control circuit 1500, which is performed by the CPU 420, is similar to that of the example embodiment 2, description thereof will be omitted.

An example of a correspondence relation between a position of an image region and a thermistor to be used for control according to the present example embodiment is indicated in Table 3.

TABLE 3

| Image region | HB21 | HB22 | HB23 | HB24 | HB25 |
|---|---|---|---|---|---|
| HB21, HB22, HB23, HB24, HB25 | Image T31-11 | Image T31-22 | Image T31-33 | Image T32-44 | Image T32-55 |
| HB21, HB22, HB23, HB24 | Image T31-11 | Image T31-22 | Image T31-33 | Image T32-44 | Image proximate T32-45 |
| HB21, HB22, HHB23 | Image T31-11 | Image T31-22 | Image T31-33 | Image proximate T32-34 | Image non-proximate T32-55 |
| HB22, HB23, HB24 | Image proximate T31-21 | Image T31-22 | Image T31-33 | Image T32-44 | Image proximate T32-45 |
| HB22, HB23 | Image proximate T31-21 | Image T31-22 | Image T31-33 | Image proximate T32-34 | Image non-proximate T32-55 |
| HB23 | Image non-proximate T31-11 | Image proximate T31-32 | Image T31-33 | Image proximate T32-34 | Image non-proximate T32-55 |

Also in the present example embodiment, similarly to the example embodiment 2, the thermistor that is to be used for maintaining setting temperature (control target temperature) is determined for each of the heating blocks HB21 to HB25. For example, in the case where the image illustrated in FIG. 12A is subjected to fixing processing, the heating block HB23 is the image block, and electrification control thereof is performed by using the main thermistor T31-33 of the heating block HB23. The heating block HB22 is the image proximate block, and electrification control thereof is performed by using the edge thermistor T31-32 of the heating block HB23 in which the image exists. Similarly, the heating block HB24 is also the image proximate block, and electrification control thereof is performed by using the edge thermistor T32-34 of the heating block HB23 in which the image exists.

Also in the present example embodiment, the heat generation amounts of the heating blocks HB22 and HB24 which are adjacent to the heating block HB23 that is the image block are controlled by the electrification control as above. It is thereby possible to maintain temperature of the edge regions of the heating block HB23 to be temperature that allows fixation, while suppressing excessive temperature rise of a non-sheet-passing portion. Moreover, by controlling heat generation of the heating blocks HB22 and HB24 which are the image proximate blocks to such an extent that temperature of the edges of the image block is not lowered and setting control target temperature of an image non-proximate block to be low, it is possible to suppress power consumption.

As described above, according to the present example embodiment, it is possible to obtain an effect similar to those of the example embodiments 1 and 2 and, furthermore, temperature control of heating blocks is able to be performed more evenly by arranging each of the edge thermistors at the end most position that is thermally affected by a proximate heating block the most.

(Example Embodiment 4)

An example embodiment 4 will be described below.

In the present example embodiment, description will be given for a heater 1600 which is obtained by modifying the configuration of the heater 1200 that has been described in the example embodiment 2. Note that, configurations and processing that are different from those of the example embodiments 1 to 3 will be described in the present example embodiment, and description for configurations and processing that are similar to those of the example embodiments 1 to 3 will be omitted.

Also in the present example embodiment, a main thermistor and an edge thermistor are arranged for each of heating blocks, but the edge thermistor is arranged in a region between adjacent heating blocks in an inclination region.

Figure 16:
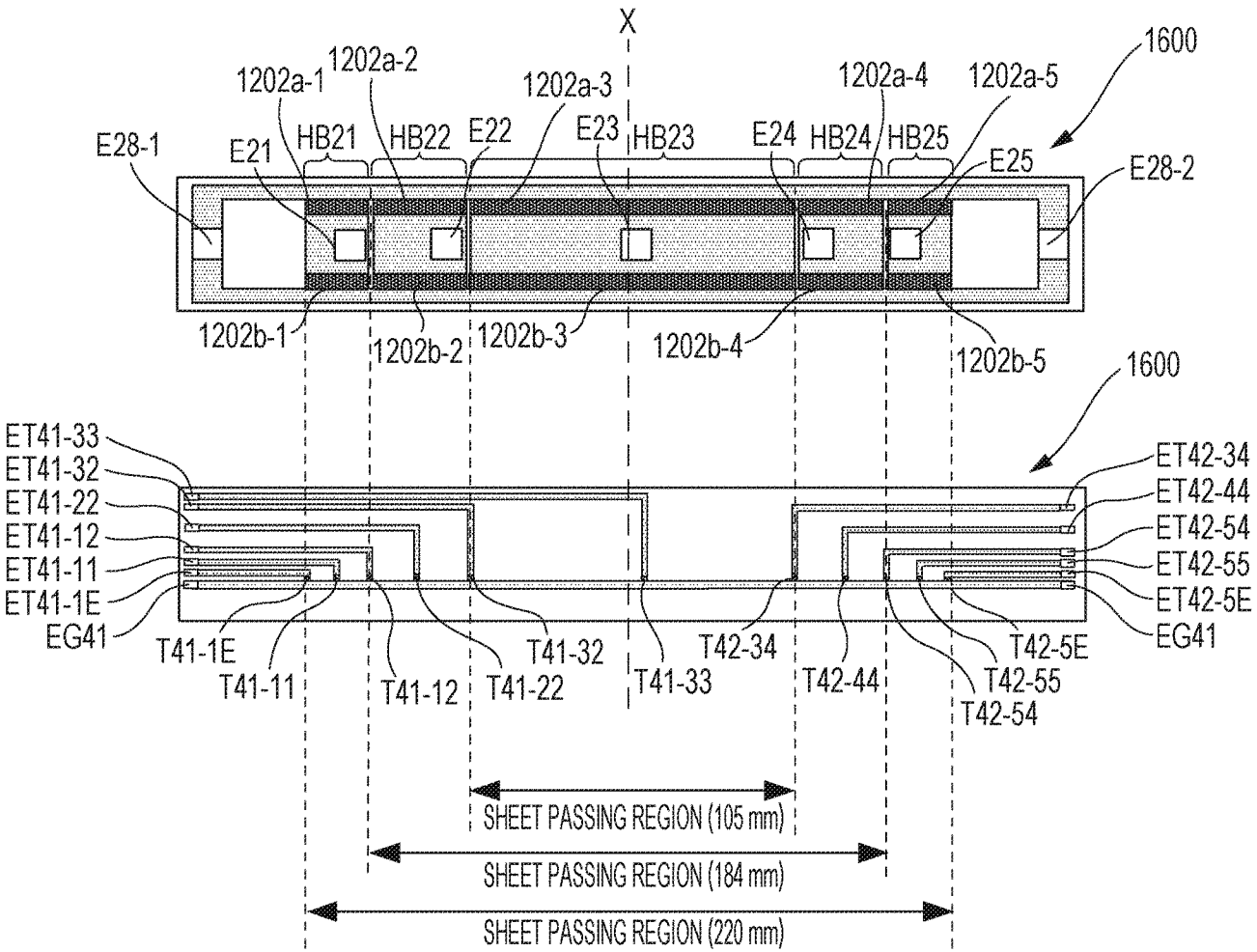
FIG. 16 is a view illustrating a configuration of a heater of an example embodiment 4.

FIG. 16 is a view illustrating a configuration of the heater 1600 of the present example embodiment. The configuration of the heater 1600 will be described in detail by using FIG. 16.

Similarly to the heater 1200 of the example embodiment 2, the heater 1600 of the present example embodiment has five heating blocks HB21 to HB25 in total. The configurations of the heating blocks HB21 to HB25 are the same as what has been described in the example embodiment 2.

On the sliding surface layer 1 on a side of a sliding surface of the heater 1600, a plurality of thermistors T41-1E, T41-11 to T41-33, T42-34 to T42-55, and T42-5E for detecting temperature of each of the heating blocks HB21 to HB25 are formed.

Hereinafter, arrangement of the thermistors with respect to the heating blocks HB21 to HB25 will be described.

In the present example embodiment, as illustrated in FIG. 16, for one heating block, one thermistor is arranged in a center region in a longitudinal direction of the heater 1600 and one thermistor is arranged between adjacent heating blocks. For example, it is configured so that the thermistor T41-33 is arranged for the heating block HB23, the thermistor T41-32 is arranged between the heating blocks HB23 and HB22, and the thermistor T42-34 is arranged between the heating blocks HB23 and HB24, and the thermistors are able to detect temperature by conductive patterns for resistance value detection ET41-32, ET41-33, and ET42-34 and a common conductive pattern EG41.

The thermistor T41-33 is a main thermistor by which temperature of the center region is detected, and arranged in the substantially center part of the heating block HB23. Moreover, the thermistor T41-32 which is arranged between the heating blocks HB23 and HB22 and the thermistor T42-34 which is arranged between the heating blocks HB23 and HB24 are edge thermistors by each of which temperature of an edge region is detected.

In this manner, with respect to each of the heating blocks HB21 to HB25, a main thermistor for detecting temperature of a center region is arranged in a substantially center part of the heating block in the longitudinal direction of the heater 1600, and an edge thermistors for detecting temperature of an edge region is arranged in a region between adjacent heating blocks.

Figure 17A:
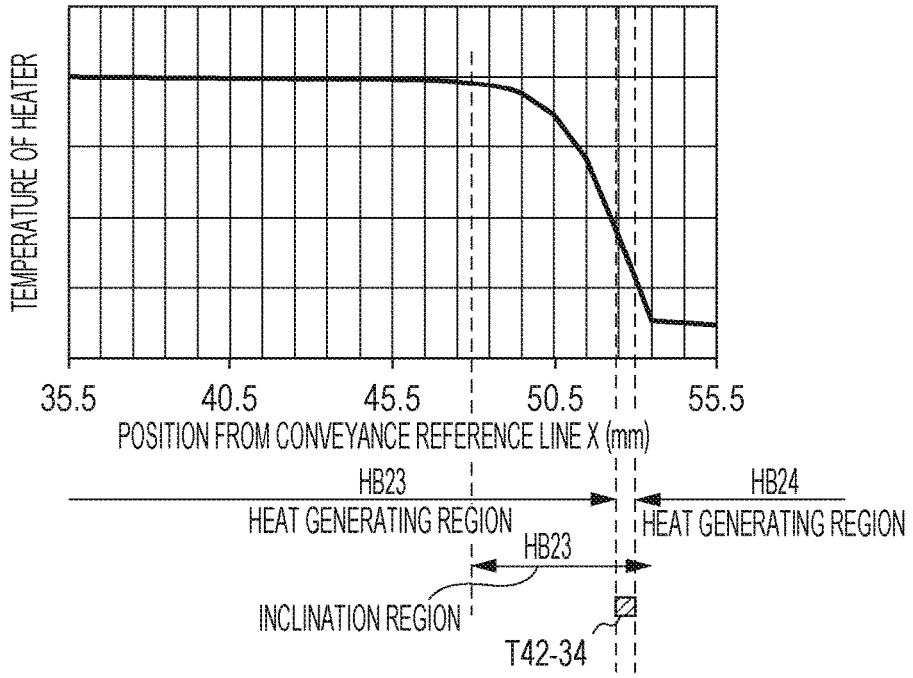
FIGS. 17A and 17B are views each illustrating temperature distribution in a longitudinal direction of the heater and arrangement of a thermistor of the example embodiment 4.
Figure 17B:
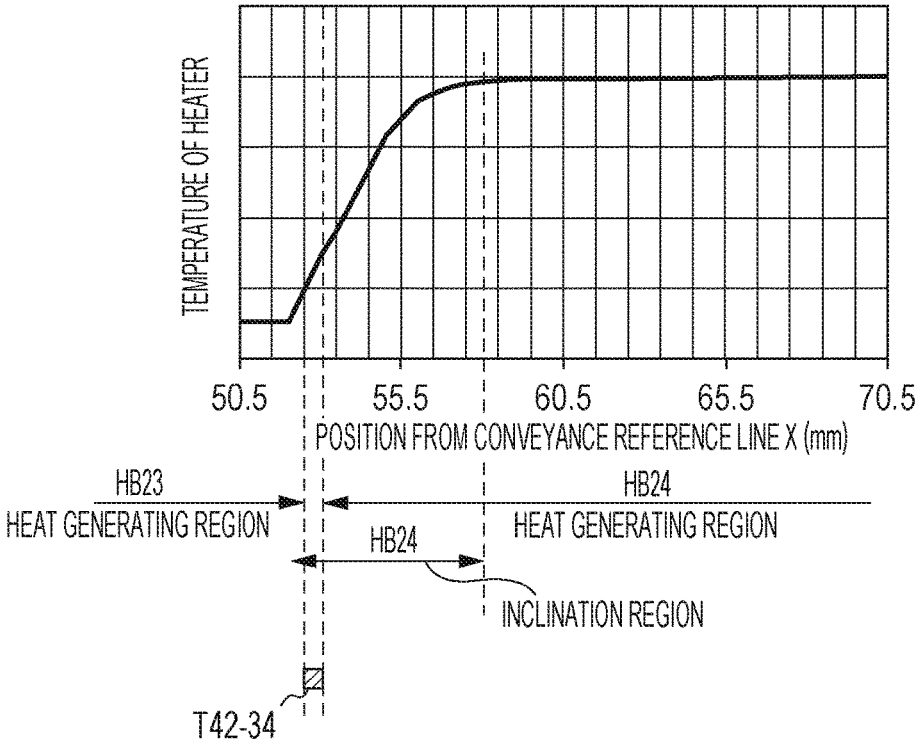

FIGS. 17A and 17B are views each illustrating temperature distribution of the heater 1600 in the longitudinal direction of the heater 1600 and detailed arrangement of the thermistor.

Here, the representative heating block HB23 will be described. FIGS. 17A and 17B illustrate temperature distribution of a region on a sliding surface layer side of the heater 1600 when the heating block HB23 is caused to generate heat alone from normal temperature (25° C.), and correspond to FIGS. 9A and 9B of the example embodiment 2, respectively.

The heating block HB23 is a region of up to 52.5 mm toward both sides of the longitudinal direction of the heater 1600 from the conveyance reference line X. In a case where the heating block HB23 is caused to generate heat alone, heat is transferred to a region of the heating block HB24 which is in proximity thereto and is not caused to generate heat, so that temperature of an inclination region that is an edge region of the heating block HB23 is lowered. Temperature of a space between the heating block HB23 and the heating block HB24 that is adjacent to the heating block HB23 is also lowered. In the present example embodiment, the edge thermistor T42-34 is arranged in the space between the heating blocks HB23 and HB24.

As described above, the heating block HB23 is a region of up to 52.5 mm toward the both sides in the longitudinal direction of the heater 1600 with the conveyance reference line X as the center, and the heat generating resistors 1202*a*-3 and 1202*b*-3 are formed in the region. Moreover, the heating block HB24 that is adjacent to the heating block HB23 is a region whose distance from the conveyance reference line X is from 53.0 mm to 92.0 mm as described above, and the heat generating resistors 1202*a*-4 and 1202*b*-4 are formed in the region. As above, there is a gap of 0.5 mm between the heat generating resistors 1202-3 and 1202-4 in the longitudinal direction of the heater 1600. In the present example embodiment, the edge thermistor T42-34 is arranged between the heating block HB23 and the heating block HB24 which are adjacent.

As above, also in the present example embodiment, the main thermistor is arranged for each of the heating blocks HB21 to HB25. Moreover, in the present example embodiment, each of the edge thermistors is arranged in a region between the adjacent heating blocks.

An example of a correspondence relation between a position of an image region and a thermistor to be used for control according to the present example embodiment is indicated in Table 4.

TABLE 4

| Image region | HB21 | HB22 | HB23 | HB24 | HB25 |
|---|---|---|---|---|---|
| HB21, HB22, HB23, HB24, HB25 | Image T41-11 | Image T41-22 | Image T41-33 | Image T42-44 | Image T42-55 |
| HB21, HB22, HB23, HB24 | Image T41-11 | Image T41-22 | Image T41-33 | Image T42-44 | Image proximate T42-54 |
| HB21, HB22, HHB23 | Image T41-11 | Image T41-22 | Image T41-33 | Image proximate T42-34 | Image non-proximate T42-55 |
| HB22, HB23, HB24 | Image proximate T41-12 | Image T41-22 | Image T41-33 | Image T42-44 | Image proximate T42-54 |
| HB22, HB23 | Image proximate T41-12 | Image T41-22 | Image T41-33 | Image proximate T42-34 | Image non-proximate T42-55 |
| HB23 | Image non-proximate T41-11 | Image proximate T41-32 | Image T41-33 | Image proximate T42-34 | Image non-proximate T42-55 |

Also in the present example embodiment, similarly to the example embodiment 2, the thermistor that is to be used for maintaining setting temperature (control target temperature) is determined for each of the heating blocks HB21 to HB25. For example, in the case where the image illustrated in FIG. 12A is subjected to fixing processing, the heating block HB23 is the image block, and electrification control thereof is performed by using the main thermistor T41-33 of the heating block HB23. The heating block HB22 is the image proximate block, and electrification control thereof is performed by using the edge thermistor T41-32 between the heating block HB22 and the heating block HB23 in which the image exists. Similarly, the heating block HB24 is also the image proximate block, and electrification control thereof is performed by using the edge thermistor T42-34 between the heating block HB24 and the heating block HB23 in which the image exists.

Also in the present example embodiment, the heat generation amounts of the heating blocks HB22 and HB24 which are adjacent to the heating block HB23 that is the image block are controlled by the electrification control as above. It is thereby possible to maintain temperature of the edge regions of the heating block HB23 to be temperature that allows fixation, while suppressing excessive temperature rise of a non-sheet-passing portion. Moreover, by controlling heat generation of the heating blocks HB22 and HB24 which are the image proximate blocks to such an extent that temperature of the edges of the image block is not lowered and setting control target temperature of an image non-proximate block to be low, it is possible to suppress power consumption.

As described above, according to the present example embodiment, it is possible to obtain an effect similar to those of the example embodiments 1 and 2 and, furthermore, temperature control of heating blocks is able to be performed more evenly by arranging each of the edge thermistors at a position that is thermally affected by a proximate heating block the most. Furthermore, by arranging each of the edge thermistors between adjacent heating blocks, two adjacent heating blocks are able to be controlled by a common edge thermistor, so that, compared with the example embodiment 3, it is possible to reduce the numbers of thermistors and circuits and simplify a configuration.

(Example Embodiment 5)

An example embodiment 5 will be described below.

In the present example embodiment, description will be given for a configuration in which electrification control of each heating block is performed in accordance with width information of a recording material by using the heater 1100 and the control circuit 1400 that have been described in the example embodiment 1. Furthermore, in the present example embodiment, description will be given for a configuration in which throughput (the number of passing sheets per unit time) is controlled by using an edge thermistor. Note that, configurations and processing that are different from those of the example embodiment 1 will be described in the present example embodiment, and description for configurations and processing that are similar to those of the example embodiment 1 will be omitted.

Arrangement of thermistors in each of the heating blocks HB11 to HB17 of the heater 1100 is indicated in Table 5 in detail. In Table 5, a position of each of the thermistors indicates a distance from the conveyance reference line X, and a side of the electrode E18-1 is defined as minus and a side of the electrode E18-2 is defined as plus.

TABLE 5

| Heating block | Main thermistor | Edge thermistor |
|---|---|---|
| HB11 | T11-1C −106.5 mm | T11-1E −109 mm |
| HB12 | T11-2C −98 mm | T11-2E −104 mm |

TABLE 5-continued

| Heating block | Main thermistor | Edge thermistor | |
|---|---|---|---|
| HB13 | T11-3C<br>−83 mm | T11-3E<br>−91.5 mm | |
| HB14 | T11-4C<br>0 mm | T11-4E<br>−74 mm | T12-4E<br>+74 mm |
| HB15 | T12-5C<br>+83 mm | T12-5E<br>+91.5 mm | |
| HB16 | T12-6C<br>+98 mm | T12-6E<br>+104 mm | |
| HB17 | T12-7C<br>+106.5 mm | T12-7E<br>+109 mm | |

Figure 18:
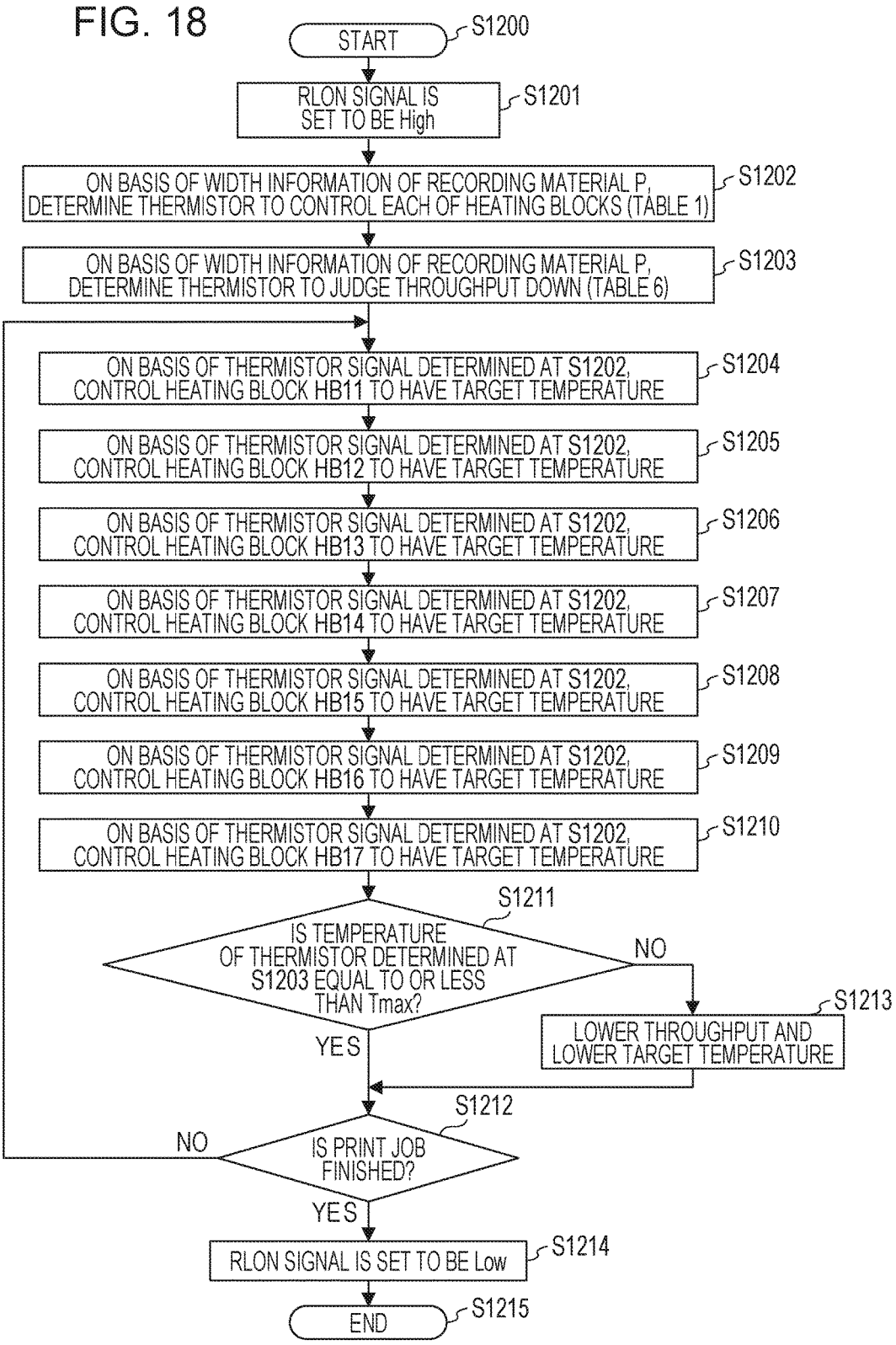
FIG. 18 is a flowchart for explaining control processing of a control circuit by a CPU of an example embodiment 5.

FIG. 18 is a flowchart for explaining a control sequence of the control circuit 1400 by the CPU 420.

When a print request is generated at S1200, the relays 1430 and 1440 are brought into the ON state at S1201. At S1202, in accordance with information of the recording material P, the thermistor that is to be used for controlling each of the heating blocks HB11 to HB17 to maintain setting temperature is determined. Table 1 described above indicates the thermistor for controlling each of the heating blocks HB11 to HB17 in accordance with the width W of the recording material P. At S1203, in accordance with the information of the recording material P, the thermistor that is to be used for judging throughput down is determined.

The thermistor to judge throughput down is indicated in Table 6 in accordance with the width W of the recording material P.

TABLE 6

| Width W of recording material | Temperature detection of non-sheet-passing-portion |
|---|---|
| 210 mm < W ≤ 218 mm | T11-1E and T12-7E |
| 185 mm < W ≤ 208 mm | T11-2E and T12-6E |
| 150 mm < W ≤ 183 mm | T11-3E and T12-5E |
| W ≤ 148 mm | T11-4E and T12-4E |

As indicated in Table 5 and Table 6, as the thermistor to be used for judging throughput down, the thermistor that is arranged in a non-sheet-passing region in the heating block through which the recording material P passes is selected.

Subsequently, at S1204 to S1210, each of the triacs 1411 to 1417 is subjected to PI control so that detected temperature of the thermistor determined at S1202 achieves the control target temperature, and power to be supplied to the each of the heating blocks HB11 to HB17 is controlled. Note that, setting temperature of each of the heating blocks HB11 to HB17 is set in accordance with size information of the recording material P.

At S1211, whether or not the detected temperature of the thermistor determined at S1203 is equal to or less than predetermined threshold temperature (allowable temperature) Tmax. In a case where the temperature of the thermistor exceeds the threshold temperature Tmax, sheet feeding time of the recording material P is extended by time t and a conveyance interval of the recording material P is extended. Thereby, it is possible to suppress the temperature rise of the non-sheet-passing portion.

In a case where the temperature of the thermistor at S1211 does not exceed the threshold temperature Tmax, the procedure moves to S1212. At S1212, control of S1204 to S1211 is iterated until it is detected that print job is finished. When it is detected at S1212 that print job is finished, the relays 1430 and 1440 are turned off at S1214, and the control sequence of image formation is finished at S1215.

Figure 19:
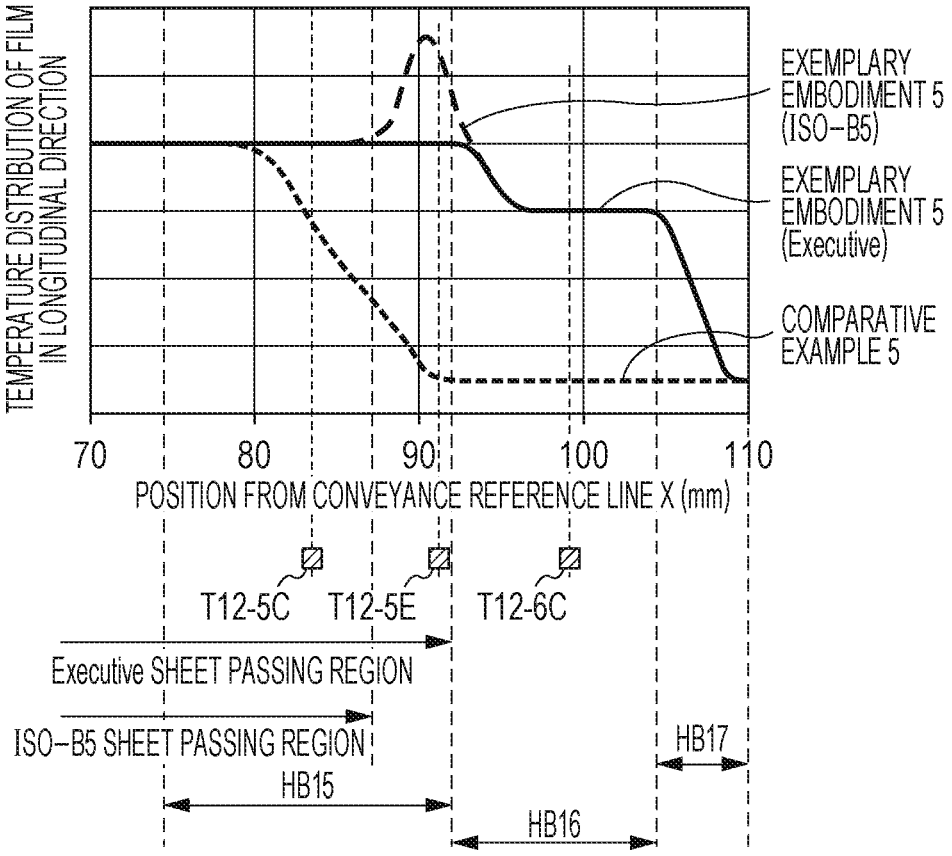
FIG. 19 is a view illustrating temperature distribution of a film in a case where recording materials are subjected to continuous sheet passing.

FIG. 19 is a view illustrating temperature distribution of a surface of the film 202 in a case where Executive paper (whose width is 184 mm) and ISO-B5 paper (whose width is 176 mm) are subjected to continuous sheet passing as the recording materials P. As indicated in Table 1, for the Executive paper, electrification control is performed by using the main thermistor in each of the heating blocks HB13 to HB15 through which the recording material P passes. For the heating block HB12, electrification control is performed by using the edge thermistor T11-3E of the heating block HB13, and, for the heating block HB16, electrification control is performed by using the edge thermistor T12-5E of the heating block HB15.

As a comparative example 5, an example in which, for a heating block that is adjacent to a sheet passing region, electrification control is performed by using a thermistor that is arranged in the heating block.

In the comparative example 5 of FIG. 19, the heating block HB16 that is adjacent to a sheet passing region of the Executive paper is controlled by using the thermistor T12-6C that is arranged in the heating block HB16. As indicated in FIG. 19, in the comparative example 5, it is difficult to stably maintain temperature of an edge region of the heating block HB15. The similar applies to the heating block HB13 which is on an opposite side with respect to the conveyance reference line X in the longitudinal direction of the heater 1100.

Moreover, as indicated in Table 6, in a case where the ISO-B5 paper (whose width is 176 mm) is used, as thermistors for judging throughput down, the edge thermistors T11-3E and T12-5E are selected.

As indicated in FIG. 19, for the ISO-B5 paper, the heating block HB15 is a sheet passing region and electrification control thereof is performed by using the main thermistor T12-5C. Since the sheet passing region of the ISO-B5 paper is narrower than an edge (edge on a side of the heating block HB16) of the heating block HB15, there is a concern that temperature of a non-sheet-passing region of the ISO-B5 paper rises as indicated in FIG. 19. However, in the present example embodiment, whether or not temperature of the non-sheet-passing portion of the ISO-B5 paper in the heater 1100 is equal to or less than the predetermined threshold temperature (allowable temperature) Tmax is judged by using the edge thermistor T12-5E. Here, the edge thermistor T12-5E is a thermistor arranged in a non-sheet-passing region in the heating block HB15 through which the recording material P passes. In a case where temperature of the edge thermistor T12-5E exceeds the threshold temperature Tmax, the sheet feeding time of the recording material P is extended by the time t at S1213. It is thereby possible to suppress the temperature rise of the non-sheet-passing portion. Although description has been given for the heating block HB15 by using FIG. 19, the similar applies to the heating block HB13. Moreover, also in a case where the recording material P having a different width indicated in Table 6 is used, it is possible to obtain a similar effect by performing control of throughput in a similar manner to that of the present example embodiment.

As described above, according to the present example embodiment, it is possible to obtain an effect similar to that of the example embodiment 1 and, furthermore, to suppress temperature rise of a non-sheet-passing portion even in a case where positions of an edge of a heating block and an edge of a recording material are different in a longitudinal direction of a heater.

The respective example embodiments described above are provided in order to exemplify an embodiment of the disclosure, and are able to be combined or variously modified as much as possible within a range not departing from the gist of the disclosure.

While the present disclosure has been described with reference to multiple example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Application No. 2017-041743, filed Mar. 6, 2017, and Japanese Patent Application No. 2018-004387, filed Jan. 15, 2018, which are hereby incorporated by reference herein in their entirety.

What is claimed is:

1. A heater that is used for an image heating device, the heater comprising:

a substrate; and a plurality of heating blocks that are provided on the substrate and generate heat upon power supply, the plurality of heating blocks being arrayed along a longitudinal direction of the heater and being able to independently generate heat, wherein a plurality of temperature detection elements are provided in at least one of the plurality of heating blocks, wherein, in a case where only one of the heating blocks, in which the plurality of temperature detection elements are provided, is caused to generate heat, temperature distribution of the heating block, in which the plurality of temperature detection elements are provided, in the longitudinal direction is inclined so as to be lowered as being closer to both edges, and wherein one of the plurality of temperature detection elements is arranged in an inclination region in which the temperature distribution is inclined.

2. The heater according to claim 1, wherein the temperature detection element is provided in both of two inclination regions that are included in the one heating block.

3. The heater according to claim 1, wherein the temperature detection element provided in the inclination region is provided in an end most part of the heating block in the longitudinal direction.

4. The heater according to claim 1, wherein each of the heating blocks includes a first conductive element and a second conductive element which are provided on the substrate along the longitudinal direction and a heat generating element that is connected between the first conductive element and the second conductive element and generates heat upon power supply.

5. The heater according to claim 1, wherein the plurality of temperature detection elements are provided on a surface of the substrate, which is opposite to a surface on which the heating blocks are provided.

6. An image heating device that heats an image formed on a recording material, the image heating device comprising:

a film that has a tubular shape;

a heater that is in contact with an inner surface of the film; and a control portion that controls power to be supplied to the heater, wherein the heater includes:

a substrate; and a plurality of heating blocks that are provided on the substrate and generate heat upon power supply, the plurality of heating blocks being arrayed along a longitudinal direction of the heater and being able to independently generate heat, wherein a plurality of temperature detection elements are provided in at least one of the plurality of heating blocks, wherein, in a case where only one of the heating blocks, in which the plurality of temperature detection elements are provided, is caused to generate heat, temperature distribution of the heating block, in which the plurality of temperature detection elements are provided, in the longitudinal direction is inclined so as to be lowered as being closer to both edges, and wherein one of the plurality of temperature detection elements is arranged in an inclination region in which the temperature distribution is inclined.

7. The image heating device according to claim 6, wherein the control portion controls, in accordance with a size of a recording material, power to be supplied to each of the plurality of heating blocks, wherein the control portion controls power to be supplied to a first heating block that corresponds to a region through which a recording material passes so that a temperature detection element that deals with the first heating block and is other than the temperature detection element arranged in the inclination region maintains control target temperature, and wherein the control portion controls power to be supplied to a second heating block through which a recording material does not pass and which is positioned next to the first heating block through which the edge of the recording material passes so that the temperature detection element that deals with the first heating block through which the edge of the recording material passes and arranged in the inclination region maintains control target temperature.

8. The image heating device according to claim 7, wherein the control target temperature of the first heating block and the control target temperature of the second heating block are the same.

9. The image heating device according to claim 7, wherein the control portion controls a third heating block through which a recording material does not pass and which is positioned next to the second heating block so that a temperature detection element that deals with the third heating block and is other than the temperature detection element arranged in the inclination region maintains control target temperature.

10. The image heating device according to claim 6, wherein the temperature detection element is provided in both of two inclination regions that are included in the one heating block.

11. The image heating device according to claim 6, wherein each of the heating blocks includes a first conductive element and a second conductive element which are provided along the longitudinal direction on the substrate and a heat generating element that is connected between the first conductive element and the second conductive element and generates heat upon power supply.

12. The mage heating device according to claim 6, wherein the plurality of temperature detection elements are provided on a surface of the substrate, which is opposite to a surface on which the heating blocks are provided.

13. The image heating device according to claim 6, further comprising a pressure roller, wherein a nip portion that pinches and conveys a recording material is formed by the heater and the pressure roller via the film.

14. The image heating device according to claim 6, wherein the control portion controls, in accordance with an image formed on a recording material, power to be supplied to each of the plurality of heating blocks, wherein the control portion controls power to be supplied to a first heating block that corresponds to a region through which an image passes so that a temperature detection element that deals with the first heating block and is other than the temperature detection element arranged in the inclination region maintains control target temperature, and wherein the control portion controls power to be supplied to a second heating block through which an image does not pass and which is positioned next to the first heating block so that the temperature detection element that deals with the first heating block next to the second heating block and is arranged in the inclination region maintains control target temperature.

15. The image heating device according to claim 14, wherein the control target temperature of the first heating block and the control target temperature of the second heating block are the same.

16. The image heating device according to claim 14, wherein the control portion controls a third heating block through which the image does not pass and which is positioned next to the second heating block so that a temperature detection element that deals with the third heating block and is other than the temperature detection element arranged in the inclination region maintains control target temperature.

* * * * *